US009937736B2

(12) United States Patent
Sato et al.

(10) Patent No.: US 9,937,736 B2
(45) Date of Patent: Apr. 10, 2018

(54) PRINTING APPARATUS, PAPER SUPPLY APPARATUS, AND PAPER SUPPLY METHOD

(71) Applicant: Nippon Primex Inc., Tokyo (JP)

(72) Inventors: Hitoshi Sato, Yamanashi (JP); Manabu Omori, Yamanashi (JP)

(73) Assignee: Nippon Primex Inc., Tokyo (JP)

( * ) Notice: Subject to any disclaimer, the term of this patent is extended or adjusted under 35 U.S.C. 154(b) by 0 days.

(21) Appl. No.: 15/361,066

(22) Filed: Nov. 24, 2016

(65) Prior Publication Data

US 2017/0072716 A1 Mar. 16, 2017

Related U.S. Application Data

(63) Continuation of application No. PCT/JP2015/056907, filed on Mar. 10, 2015.

(30) Foreign Application Priority Data

Jun. 10, 2014 (JP) ..... 2014-120041

(51) Int. Cl.
*B41J 13/00* (2006.01)
*B65H 5/28* (2006.01)
(Continued)

(52) U.S. Cl.
CPC ..... *B41J 13/0009* (2013.01); *B41J 11/0095* (2013.01); *B41J 15/042* (2013.01);
(Continued)

(58) Field of Classification Search
CPC ... B41J 15/18; B41J 15/20; B41J 15/24; B41J 15/02; B65H 19/102
See application file for complete search history.

(56) References Cited

U.S. PATENT DOCUMENTS 4,203,562 A 5/1980 DeLuca et al.
5,624,526 A * 4/1997 Perecman ..... B65H 19/1852 156/159
(Continued)

FOREIGN PATENT DOCUMENTS

JP S54-092464 7/1979
JP H04-302567 10/1992
(Continued)

OTHER PUBLICATIONS

"Office Action of Japan Counterpart Application," with machine English translation thereof, dated Jun. 6, 2017, p. 1-p. 5.
(Continued)

*Primary Examiner* — Shelby Fidler
(74) *Attorney, Agent, or Firm* — JCIPRNET

(57) ABSTRACT

A printer includes a first housing part, a second housing part, a printing part that prints on the first paper sheet and the second paper sheet, a conveying part that includes a holding part that is configured to hold the overlapping first paper sheet and the second paper sheet respectively pulled out from a first paper roll and a second paper roll, and conveys the first paper sheet out of the first paper sheet and the second paper sheet held by the holding part to the printing part, a first paper sheet sensor that detects the presence of the first paper sheet, and a controlling part that makes the conveying part convey the second paper sheet held by the holding part to the printing part when the first paper sheet sensor detects that there is no first paper sheet to be conveyed to the printing part.

13 Claims, 22 Drawing Sheets

(51) Int. Cl.

| | |
|---|---|
| ***B41J 15/04*** | (2006.01) |
| ***B41J 11/00*** | (2006.01) |
| ***B41J 15/18*** | (2006.01) |
| ***B65H 9/12*** | (2006.01) |
| ***B65H 19/12*** | (2006.01) |

(52) U.S. Cl.
CPC ..... *B41J 15/18* (2013.01); *B65H 5/28* (2013.01); *B65H 19/12* (2013.01)

(56) References Cited

U.S. PATENT DOCUMENTS

| | | | | |
|---|---|---|---|---|
| 8,424,755 | B1 * | 4/2013 | Irudayam | B41J 11/66 235/375 |
| 2009/0217835 | A1 * | 9/2009 | Rozenblum | B41J 15/042 101/484 |

FOREIGN PATENT DOCUMENTS

| | | |
|---|---|---|
| JP | H06-297799 | 10/1994 |
| JP | 2001-105676 | 4/2001 |
| JP | 2006-341989 | 12/2006 |

OTHER PUBLICATIONS

"Search Report of Europe Counterpart Application", dated Dec. 15, 2017, p. 1-p. 8.

* cited by examiner

PRINTING APPARATUS, PAPER SUPPLY APPARATUS, AND PAPER SUPPLY METHOD

CROSS-REFERENCE TO RELATED APPLICATIONS

The present application is a continuation application of International Application number PCT/JP2015/056907, filed on Mar. 10, 2015, which claims priority under 35 U.S.C. § 119(a) to Japanese Patent Application No. 2014-120041, filed on Jun. 10, 2014. The content of this application is incorporated herein by reference in their entirety.

BACKGROUND OF THE INVENTION

The present invention relates to a printing apparatus, a paper supply apparatus, and a paper supply method for printing on a paper sheet pulled out from a plurality of paper rolls.

A printing apparatus that houses, for example, two paper rolls and prints on a paper sheet pulled out from each paper roll with a printing part is used as a printing apparatus for printing on a paper roll. In this printing apparatus, a conveyance path and a discharging part dedicated for a paper sheet pulled out from each of the paper rolls are provided.

Conventionally, a method for sharing a part of the conveyance paths of the two paper rolls has been proposed. The printing apparatuses disclosed in Japanese Unexamined Patent Application Publication No. 2006-341989 and Japanese Unexamined Patent Application Publication No. 2001-105676 include dedicated paths for conveying each of the two paper rolls, a common path positioned in a downstream side of the dedicated paths, and a printing part provided on the common path, and print on the paper rolls conveyed to the common path from the dedicated path.

However, because the printing apparatuses disclosed in Japanese Unexamined Patent Application Publication No. 2006-341989 and Japanese Unexamined Patent Application Publication No. 2001-105676 require the dedicated paths for each paper roll, components such as a roller and a sensor were required for the dedicated paths, and spaces for installing the components are required. Further, operations of the roller and the sensor had to be controlled for each dedicated path.

BRIEF SUMMARY OF THE INVENTION

This invention focuses on these points, and an object of the invention is to properly convey each paper sheet of a plurality of paper rolls to a printing part with a simple configuration.

In one aspect of the present invention, a printing apparatus comprises: a first housing part that houses a first paper roll that is a roll of a first paper sheet, a second housing part that houses a second paper roll that is a roll of a second paper sheet, a printing part that prints on the first paper sheet and the second paper sheet, a conveying part including a holding part that is configured to hold the overlapping first paper sheet and the second paper sheet respectively pulled out from the first paper roll and the second paper roll, the conveying part conveying the first paper sheet out of the first paper sheet and the second paper sheet held by the holding part to the printing part, a detecting sensor that detects the presence of the first paper sheet, and a controlling part that makes the conveying part convey the second paper sheet held by the holding part to the printing part when the detecting sensor detects that there is no first paper sheet to be conveyed to the printing part is provided.

DETAILED DESCRIPTION OF THE INVENTION

1. Configuration of a Printer

Figure 1:
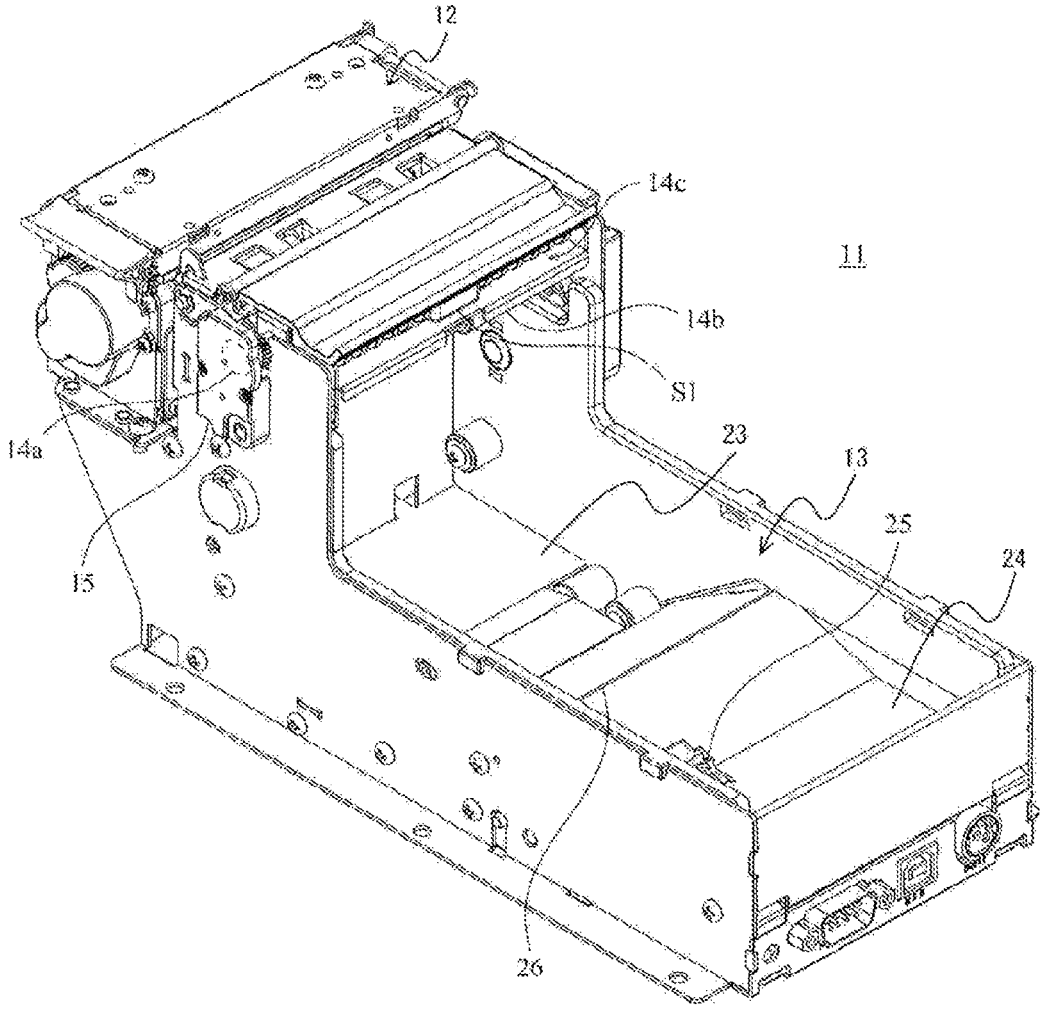
FIG. 1 shows a perspective view of a printer 11 according to one exemplary embodiment of the present invention.
Figure 2:
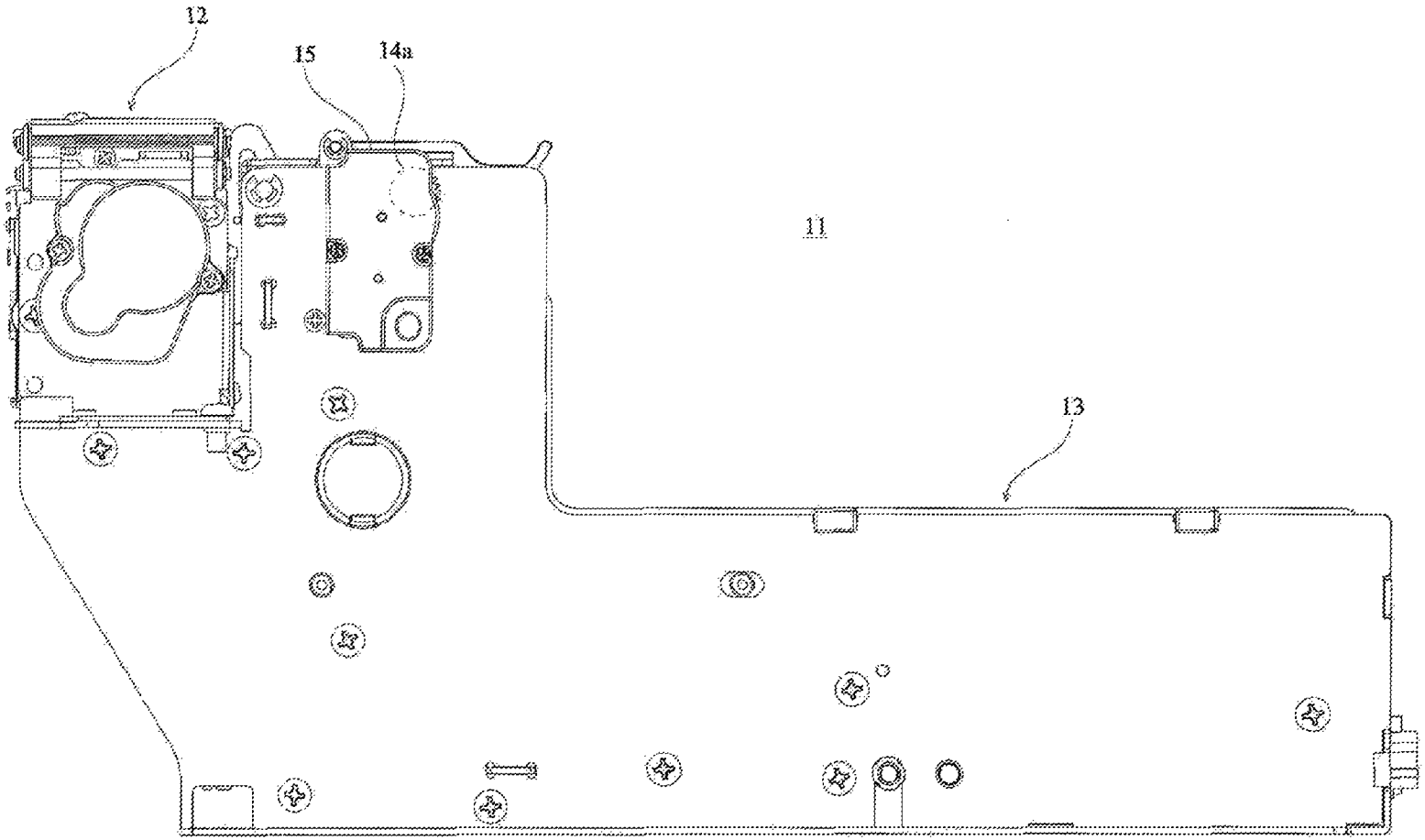
FIG. 2 shows a right side view of the printer 11.
Figure 3:
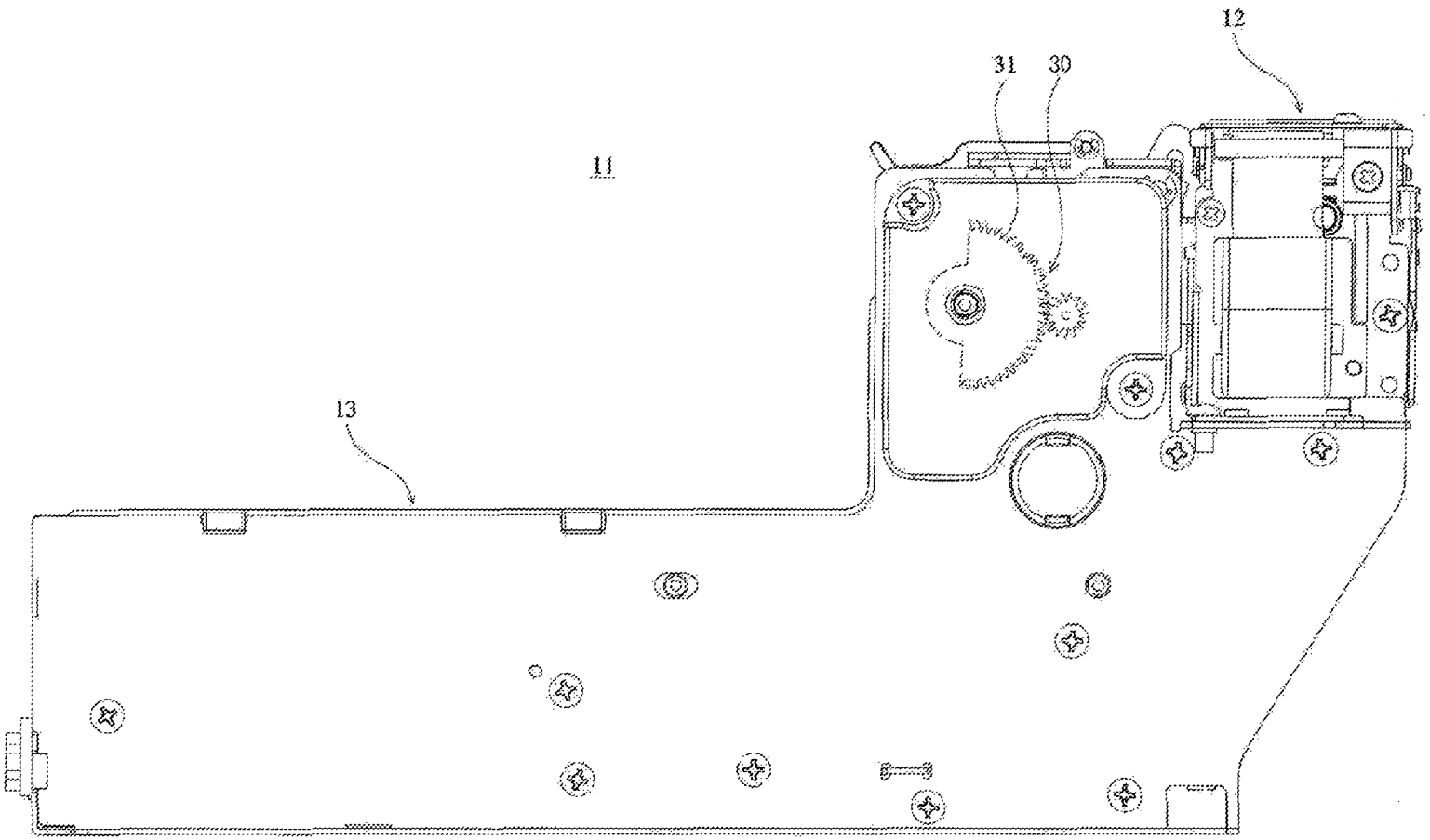
FIG. 3 shows a left side view of the printer 11.
Figure 4:
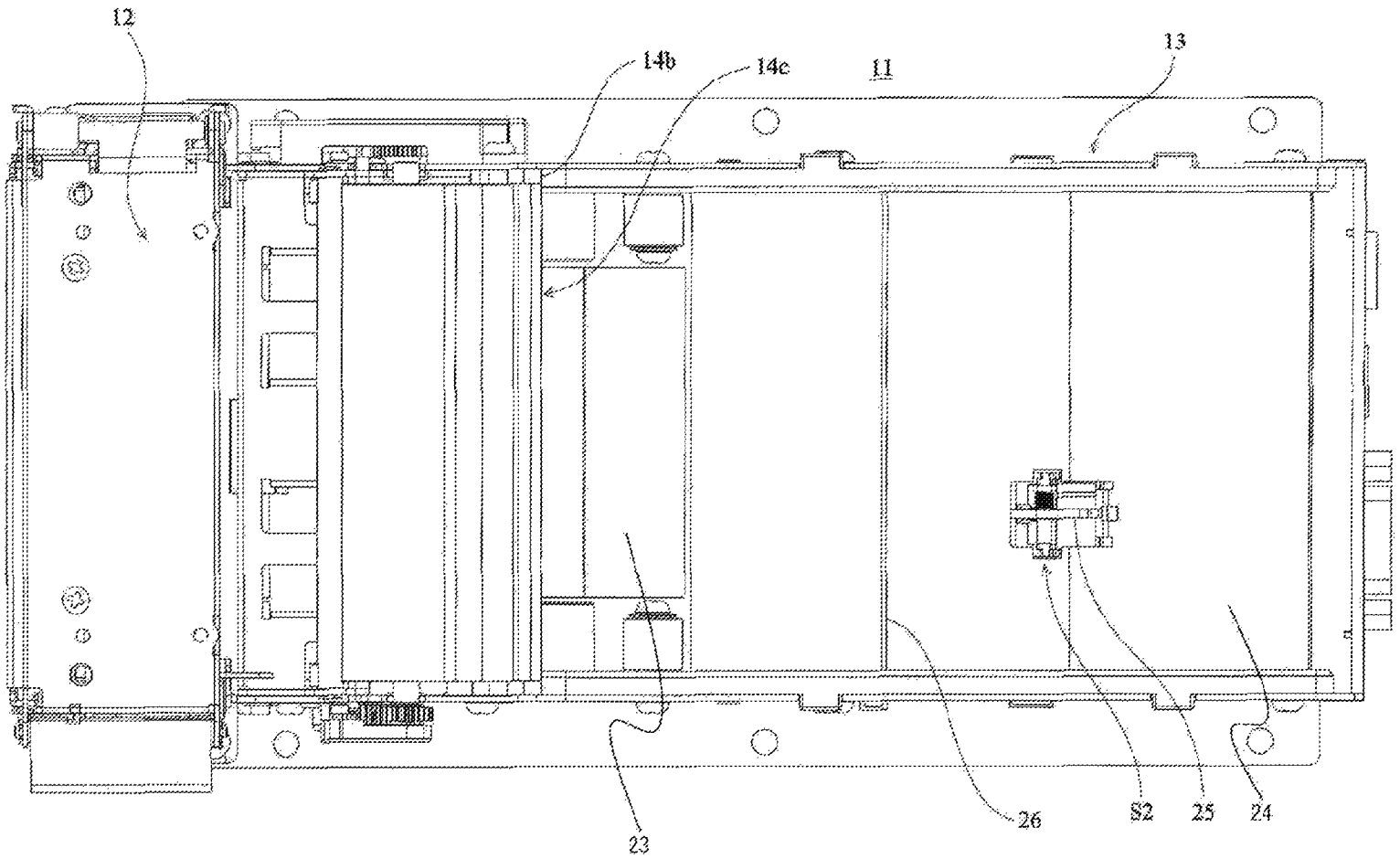
FIG. 4 shows a plane view of the printer 11.
Figure 5:
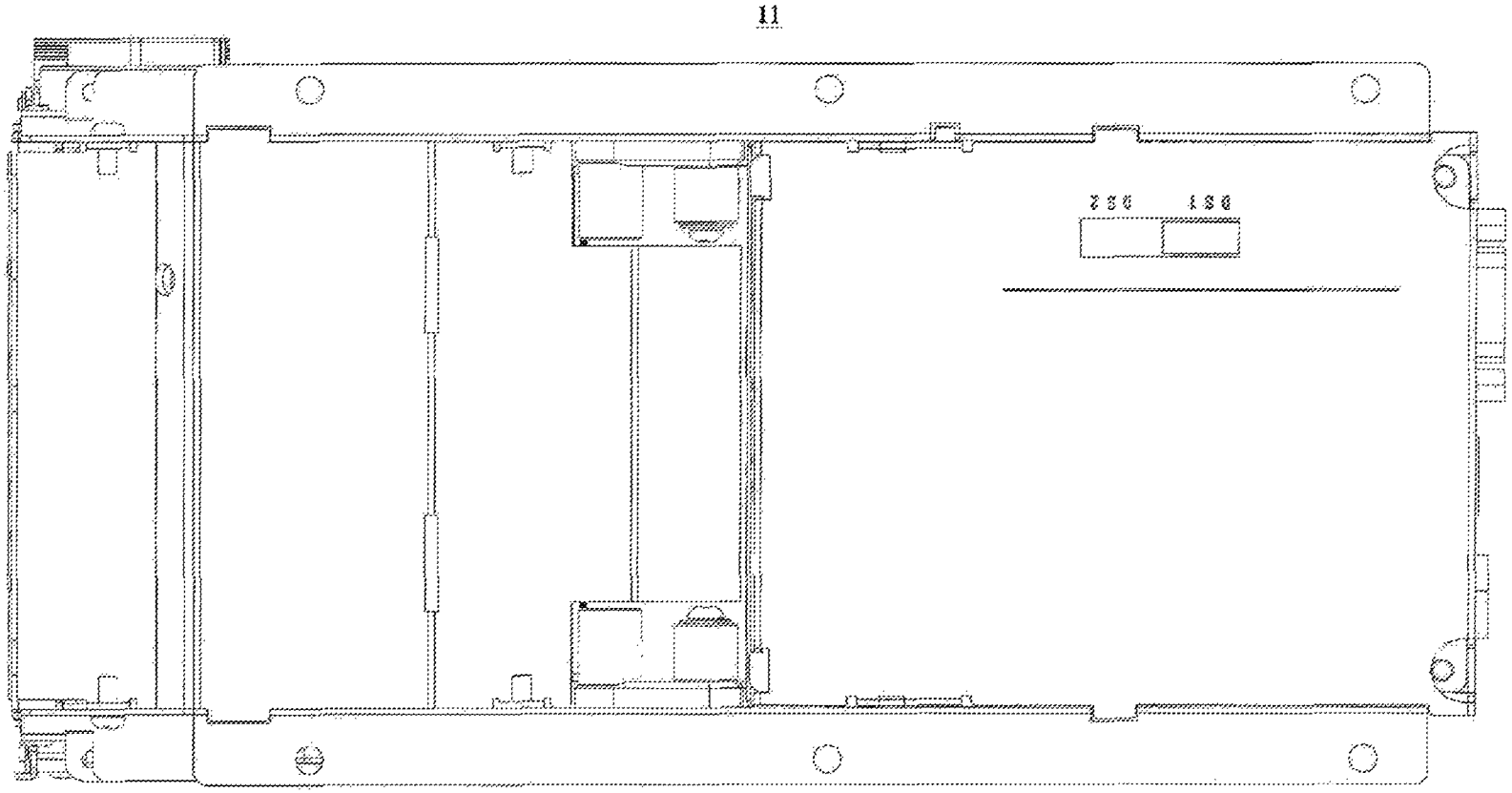
FIG. 5 shows a bottom view of the printer 11.
Figure 6:
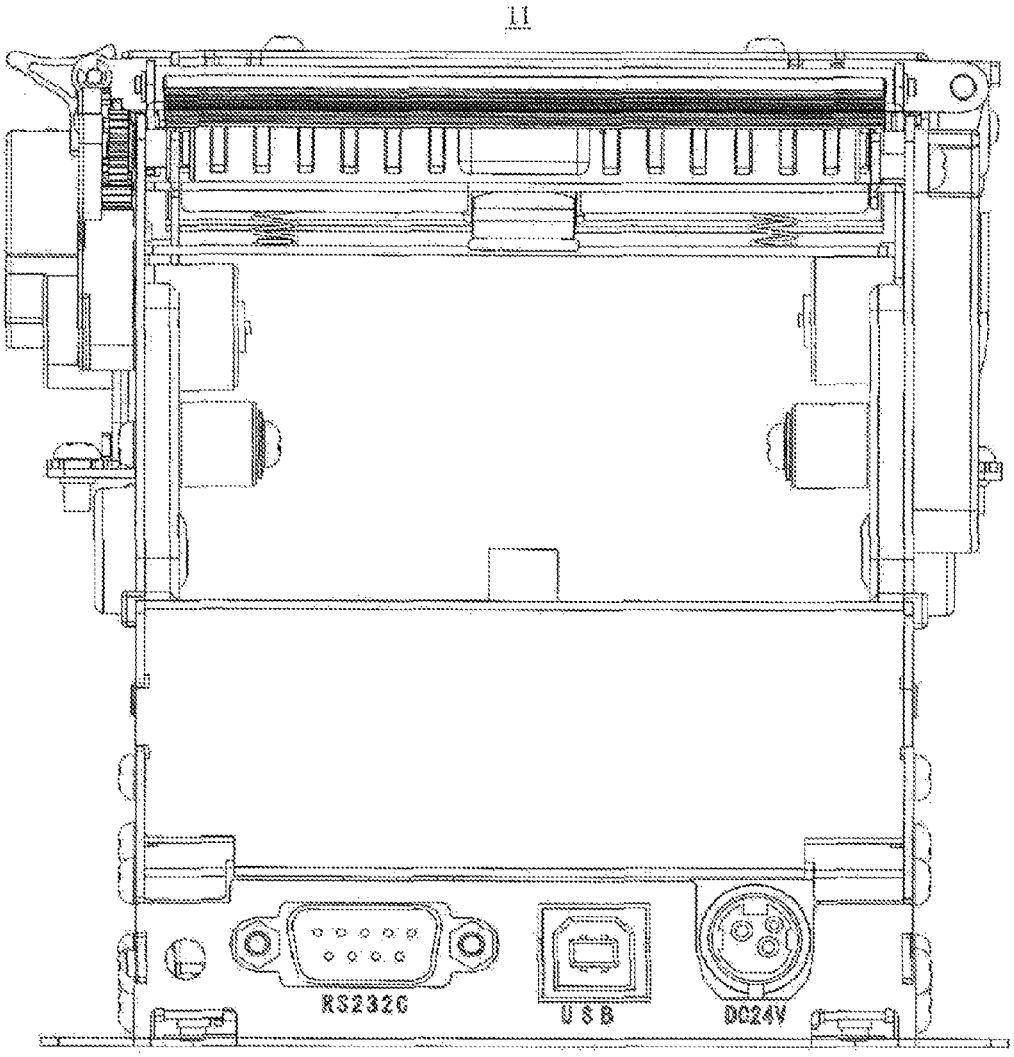
FIG. 6 shows a back view of the printer 11.
Figure 7:
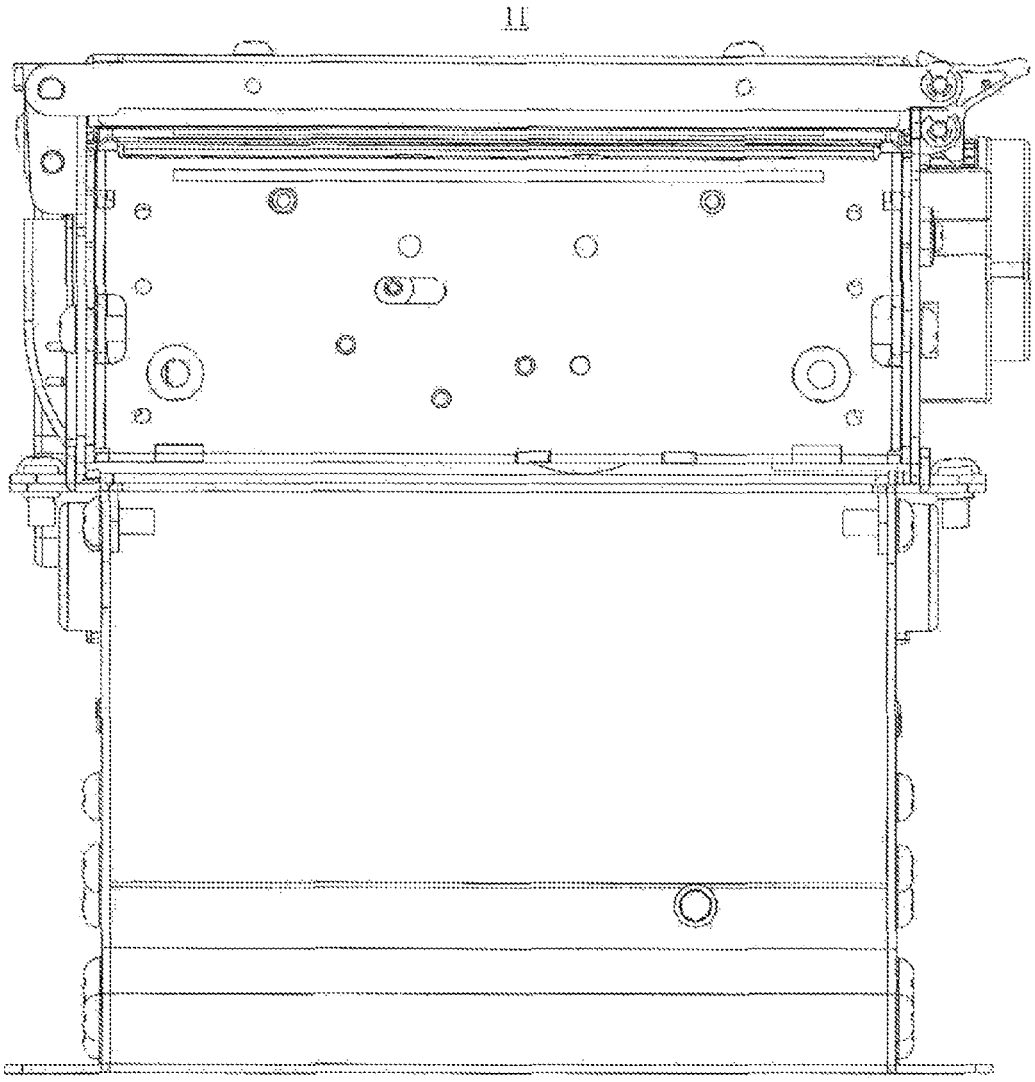
FIG. 7 shows a front view of the printer 11.
Figure 8:
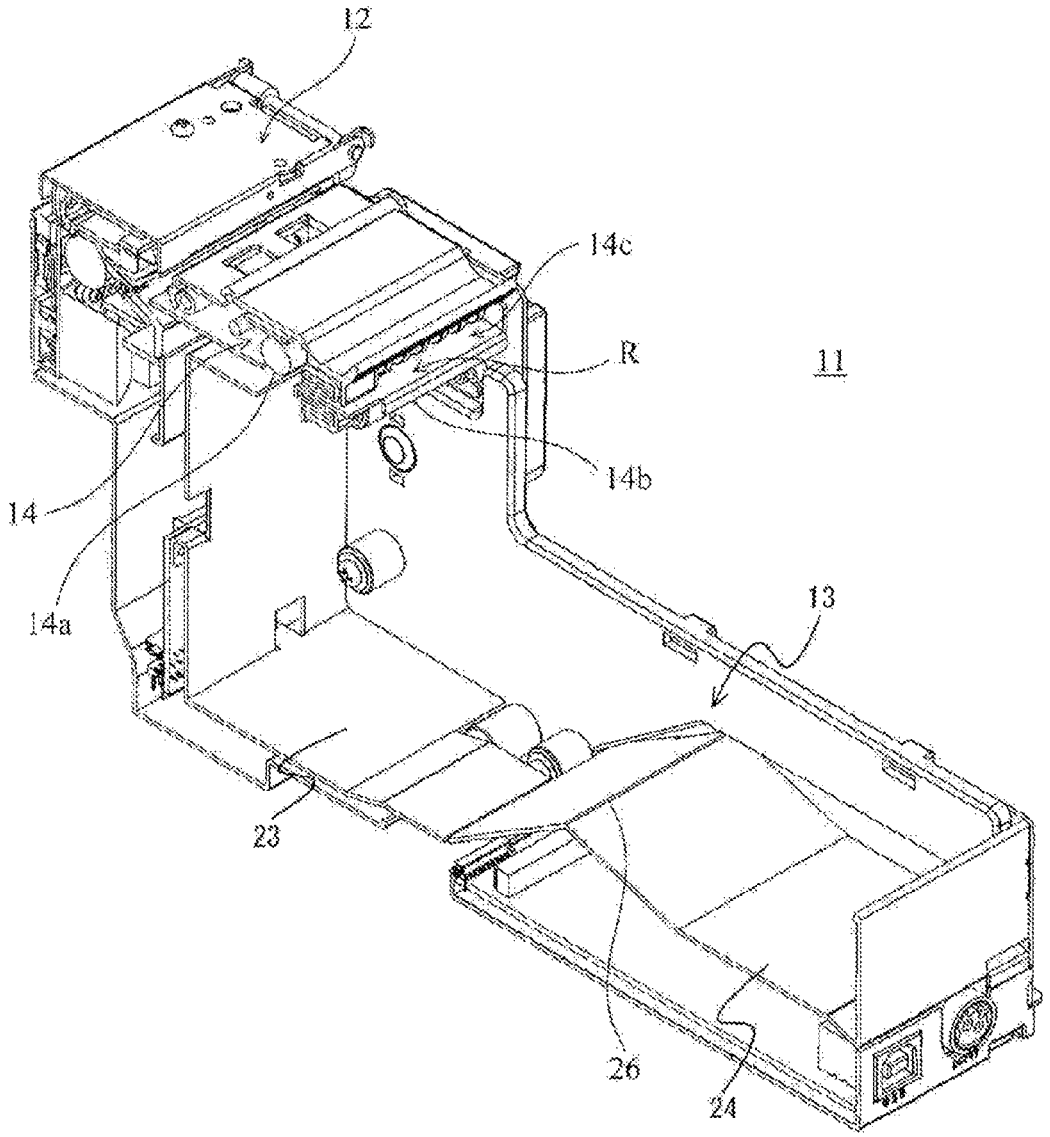
FIG. 8 shows a perspective view of a longitudinal section of the printer 11 as seen from the right side.
Figure 9:
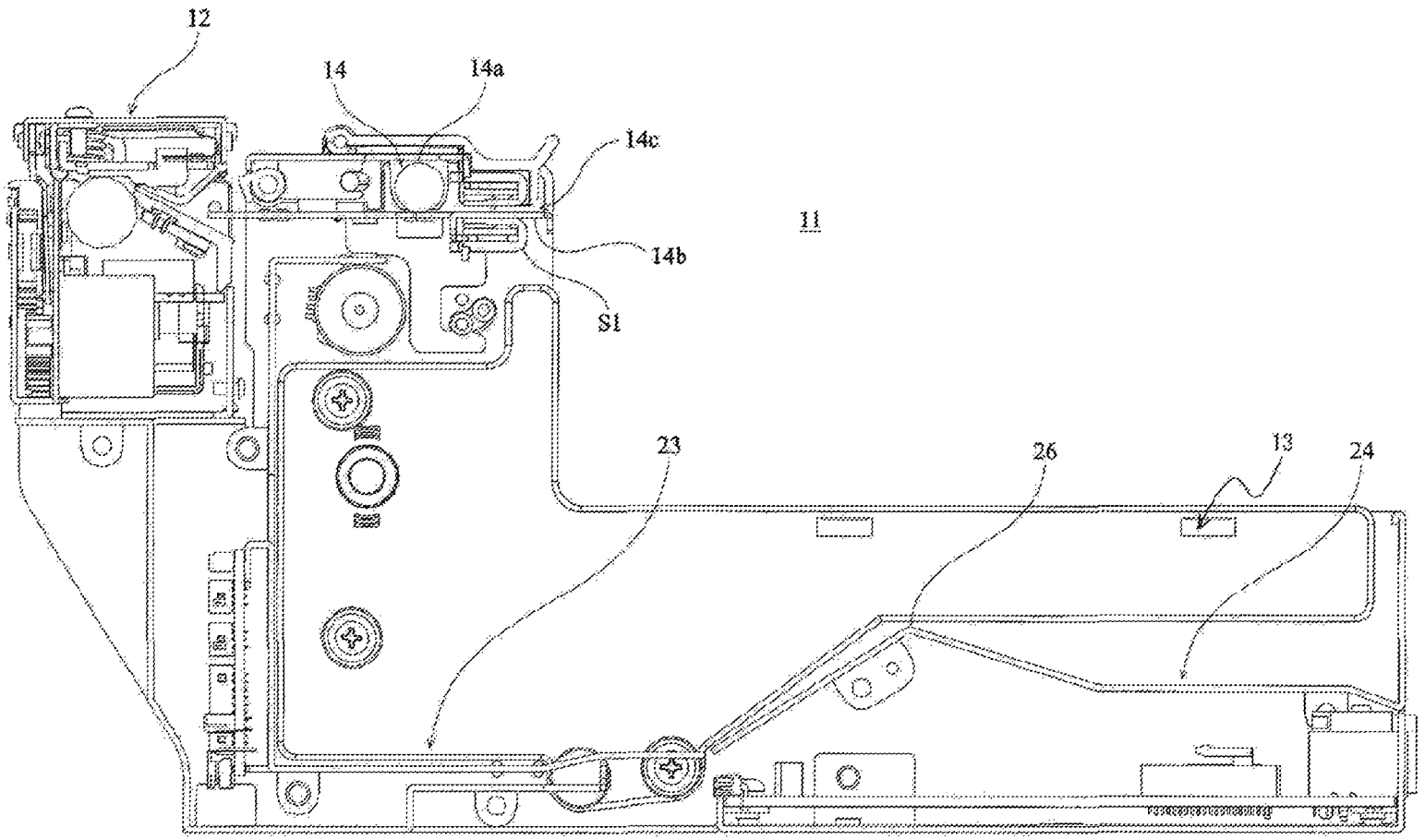
FIG. 9 shows a longitudinal section of the printer 11 as seen from the right side.
Figure 10:
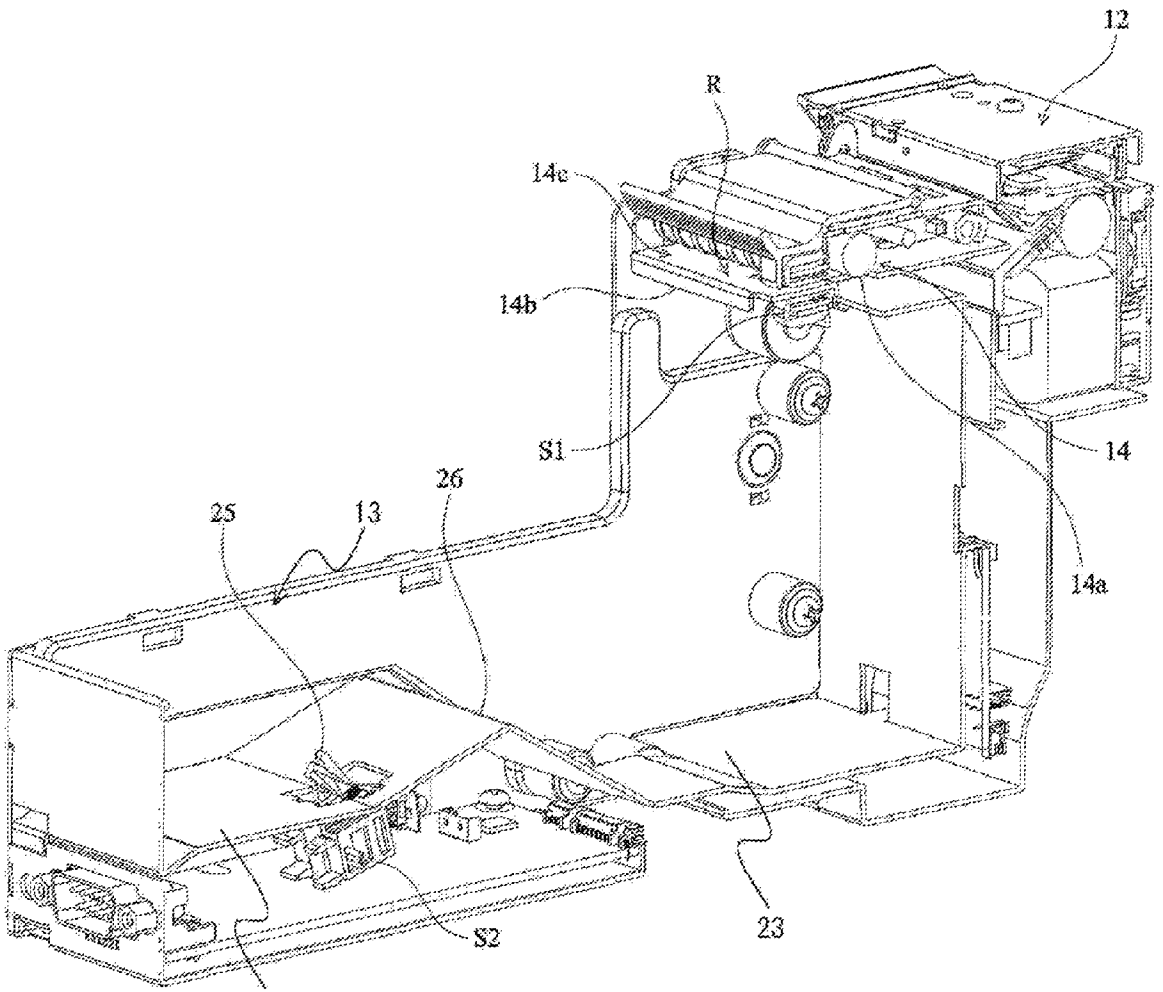
FIG. 10 shows a perspective view of a longitudinal section of the printer 11 as seen from the left side.
Figure 11:
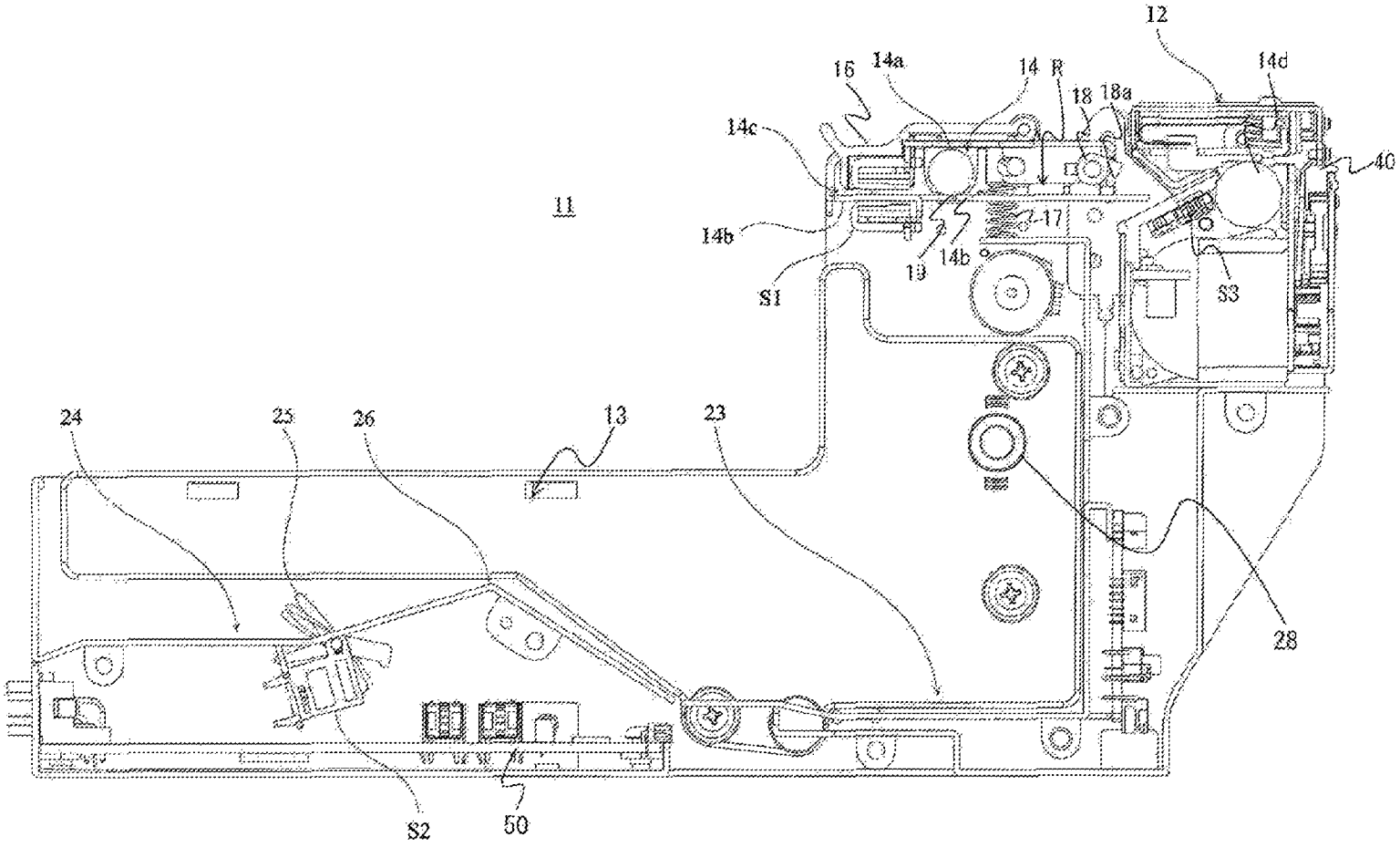
FIG. 11 shows a longitudinal section of the printer 11 as seen from the left side.
Figure 12:
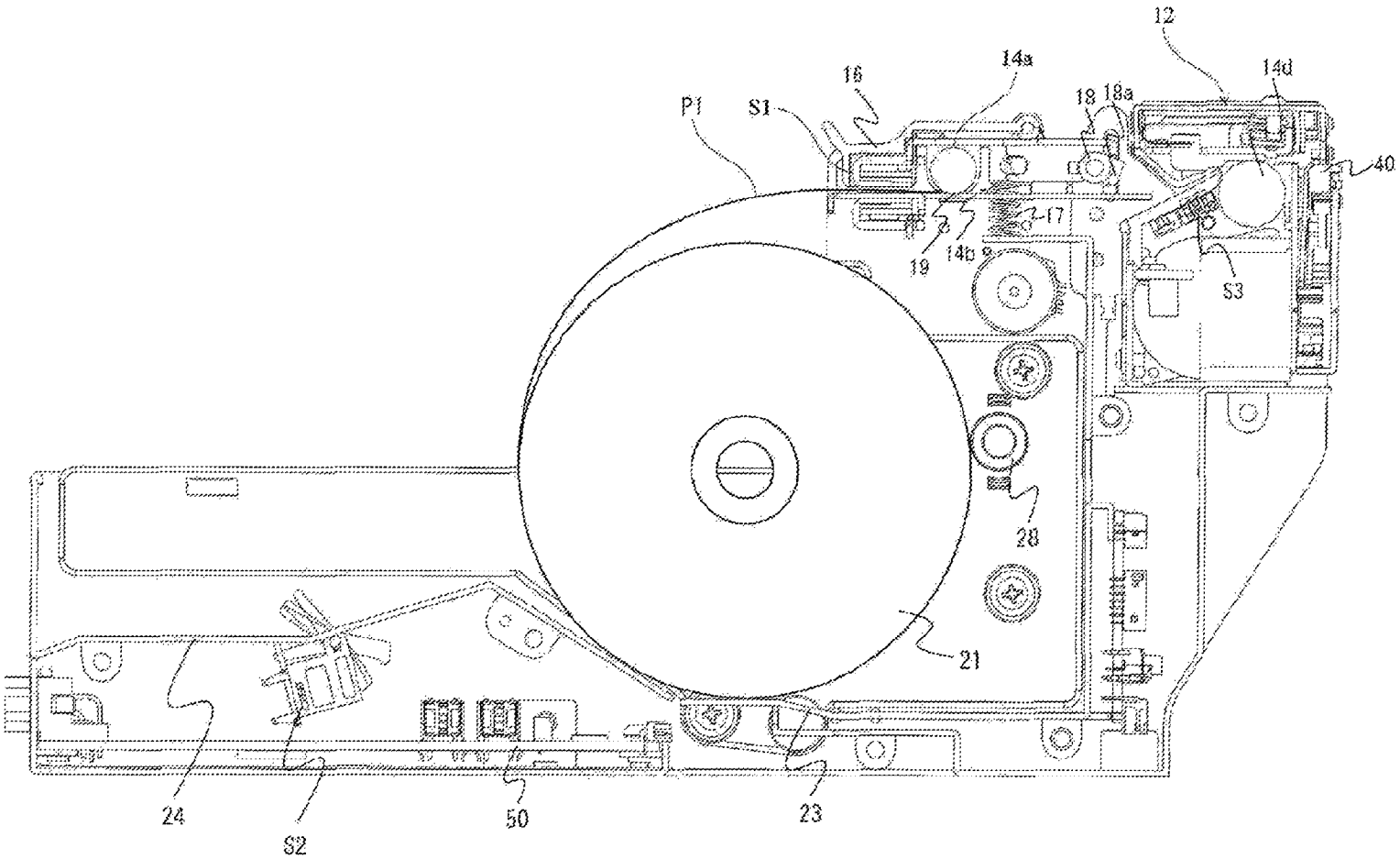
FIG. 12 shows a state where a paper feeding roller 14*a* feeds a paper sheet P1.
Figure 13:
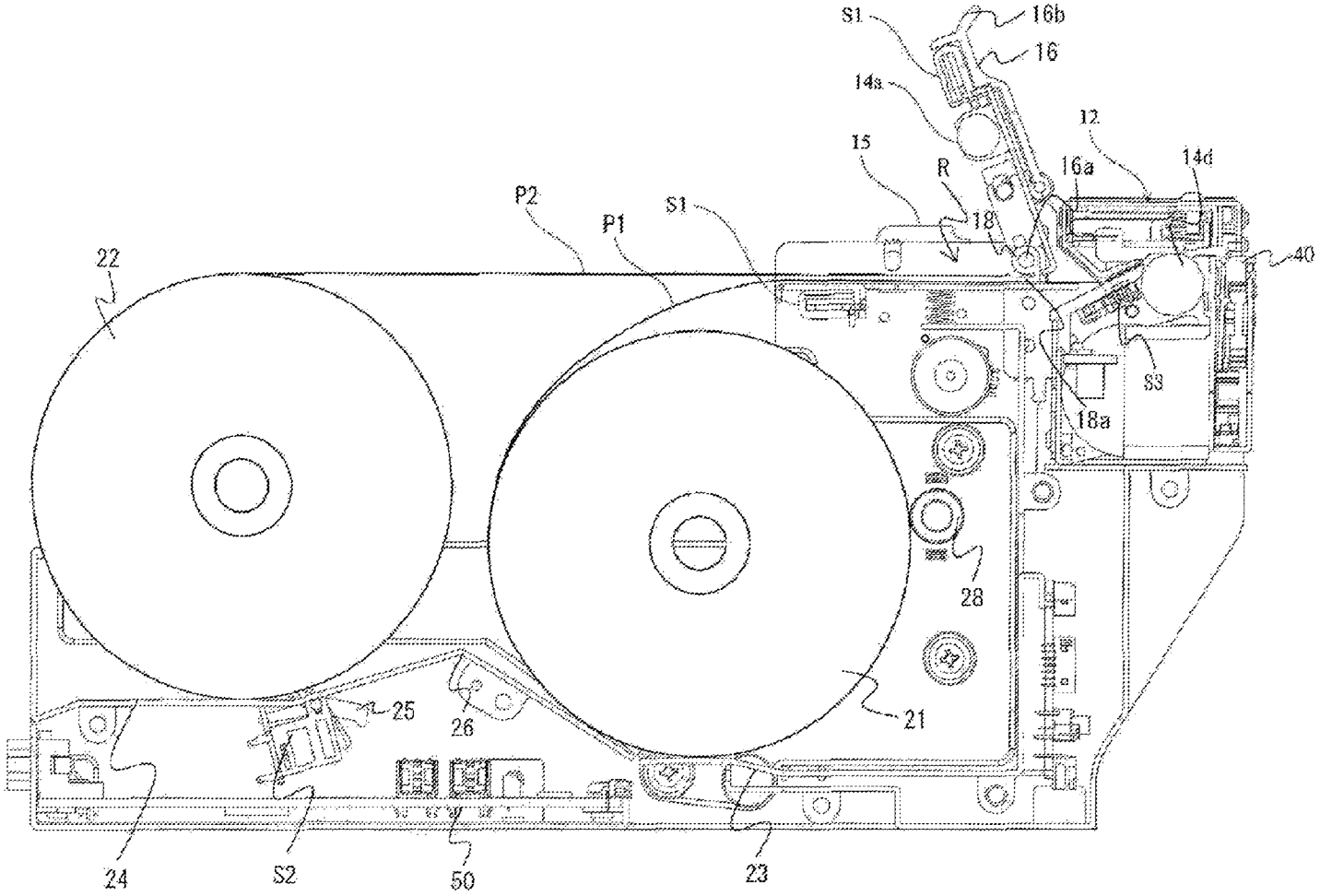
FIG. 13 shows a state where the paper feeding roller 14*a* is opened and a paper sheet P2 is put on the paper sheet P1.
Figure 14:
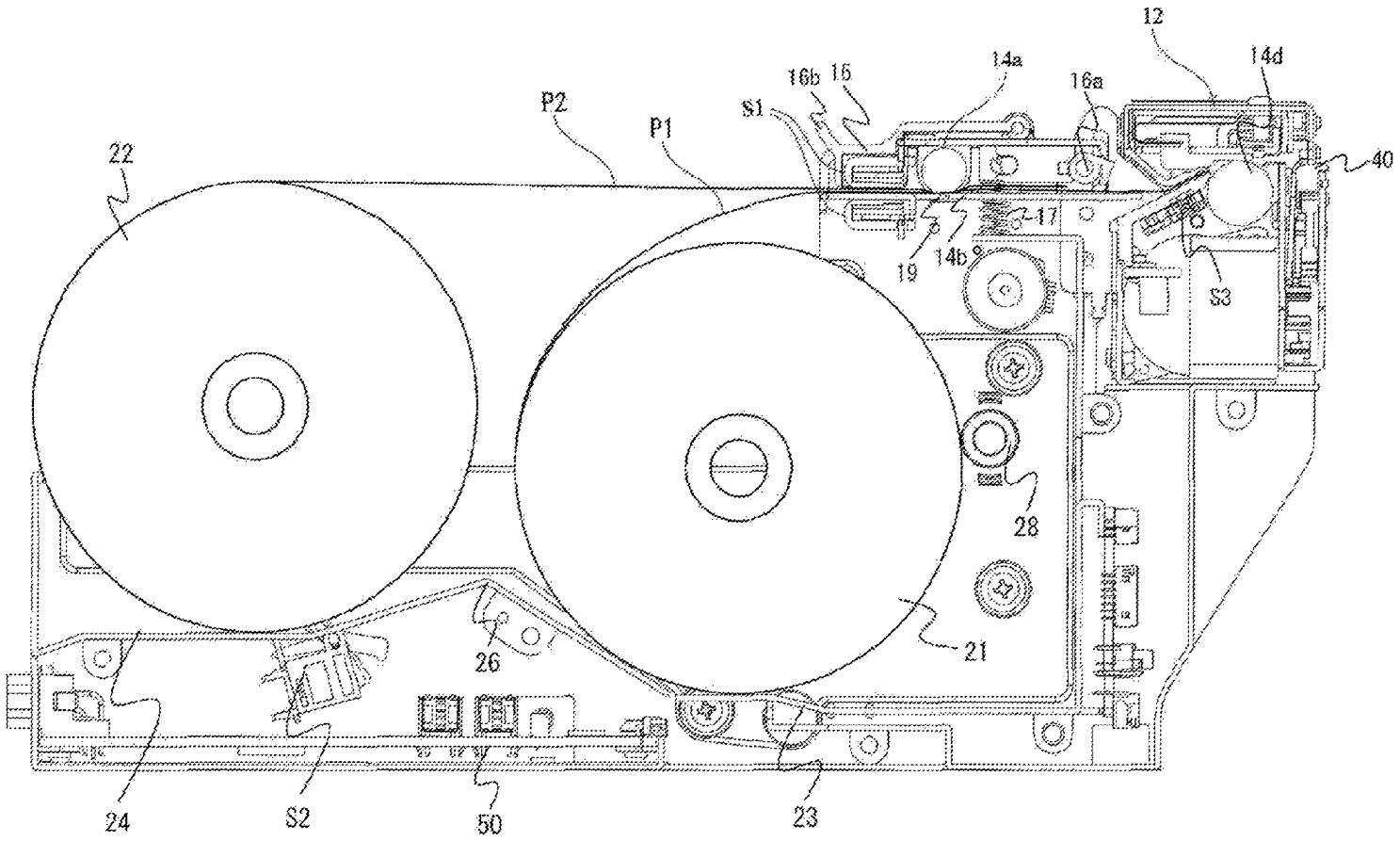
FIG. 14 shows the paper feeding roller 14*a* in a closed state.

A configuration of a printer 11 that is an example of a printing apparatus according to the present invention is explained with reference to FIGS. 1 to 14. FIG. 1 shows a perspective view of the printer 11 according to one exemplary embodiment of the present invention. FIG. 2 shows a right side view of the printer 11. FIG. 3 shows a left side view of the printer 11. FIG. 4 shows a plane view of the printer 11. FIG. 5 shows a bottom view of the printer 11. FIG. 6 shows a back view of the printer 11. FIG. 7 shows a front view of the printer 11. FIG. 8 shows a perspective view of a longitudinal section of the printer 11 as seen from the right side. FIG. 9 shows a longitudinal section of the printer 11 as seen from the right side. FIG. 10 shows a perspective view of a longitudinal section of the printer 11 as seen from the left side. FIG. 11 shows a longitudinal section of the printer 11 as seen from the left side. FIG. 12 shows a state where a paper feeding roller 14*a* feeds a paper sheet P1. FIG. 13 shows a state where the paper feeding roller 14*a* is opened and a paper sheet P2 is put on the paper sheet P1. FIG. 14 shows the paper feeding roller 14*a* in a closed state. It should be noted that FIGS. 1 to 11 show the printer 11 in which a paper roll is not yet set.

The printer 11 is an apparatus that prints on a paper sheet pulled out from a paper roll, and then cuts the paper sheet at a predetermined length and discharges the paper sheet. The printer 11 may be incorporated in, for example, a point of sale (POS) system terminal and a ticket issuing machine as an output apparatus. The printer 11 according to the present embodiment is capable of housing two paper rolls and is capable of continuously printing on another paper roll when one of the paper rolls runs out during printing. As shown in FIGS. 1 to 11, the printer 11 includes a printing part 12, a paper tray 13, a conveying part 14, a cutting part 40, and a controlling part 50.

As shown in FIG. 13, the paper tray 13 is capable of housing a first paper roll 21 and a second paper roll 22. The paper tray 13 houses the first paper roll 21 and the second paper roll 22 in a line along a horizontal direction. As shown in FIG. 11, the paper tray 13 includes a first housing part 23, a second housing part 24, a lever 25, a convex part 26, a roller 28, and a detecting sensor S2.

The first housing part 23 houses the first paper roll 21 that is a roll of a first paper sheet P1. The second housing part 24 houses the second paper roll 22 that is a roll of a second paper sheet P2. The first housing part 23 is positioned at a downstream side of the second housing part 24 in a pull-out direction of the paper sheet P1. Further, the second housing part 24 is arranged at a slightly higher position than the first housing part 23. In the present exemplary embodiment, the first paper roll 21 and the second paper roll 22 have no core. Accordingly, there is no need to collect the core when the first paper roll 21 and the second paper roll 22 run out. However, the first paper roll 21 and the second paper roll 22 are not limited as above and may have cores.

The detecting sensor S2 is provided at a bottom part of the second housing part 24 and detects the presence of the second paper roll 22. A transmission-type or a reflection-type photo interrupter including a light emitting part and a light receiving part, for example, is used as the detecting sensor S2. It should be noted that the detecting sensor S2 may be a detecting switch instead of a photo interrupter.

The lever 25 is rotatably supported at the bottom part of the second housing part 24 and causes the light emitted from the light-emitting part of the detecting sensor S2 to be blocked or passed. For example, as shown in FIG. 13, when the second paper roll 22 is set to the second housing part 24, the lever 25 is rotated downward and moved to a position to block the light. When the light is blocked by the lever 25 and the light-receiving part does not receive the light, the detecting sensor S2 detects that the second paper roll 22 is in the second housing part 24.

It should be noted that the detecting sensor S2 and the lever 25 do not have to be provided in the second housing part 24. Further, a detecting sensor for detecting the presence of the first paper roll 21 and the remainder of the first paper roll 21 may be installed in the first housing part 23. When the second paper roll 22 in the second housing part 24 is moved to the first housing part 23 as explained below, this detecting sensor detects the presence and the remainder of the second paper roll 22 in the first housing part 23.

As shown in FIG. 11, the convex part 26 is provided between the first housing part 23 and the second housing part 24. The convex part 26 has a function that regulates the movement of the second paper roll 22 housed in the second housing part 24 towards the first housing part 23.

The roller 28 is rotatably provided in the first housing part 23. As shown in FIG. 12, the roller 28 has a function for smoothly pulling out the paper sheet P1 from the first paper roll 21 by touching the outer peripheral surface of the first paper roll 21. In the present exemplary embodiment, a plurality of the rollers 28 is provided for stabilizing the behavior of the first paper roll 21 when the paper sheet P1 is pulled out. It should be noted that the first housing part 23 is provided with a damper member (not shown in figures) for stabilizing the behavior of the paper roll 21 in a crosswise direction by touching side faces of the paper roll 21. The damper members are provided on both sides of the first paper roll 21 in the crosswise direction.

Further, the paper tray 13 houses two paper rolls (the first paper roll 21 and the second paper roll 22) in the above, but it is not limited to this. For example, the printer 11 may include a paper tray that is capable of housing three paper rolls or more.

The conveying part 14 pulls out the paper sheet P1 or the paper sheet P2 from the first paper roll 21 or the second paper roll 22 and conveys it to the printing part 12. In the present exemplary embodiment, the conveying part 14 includes a common conveying path R (FIG. 11) that conveys both of the paper sheet P1 and the paper sheet P2, and does not include a conveying path dedicated for the paper sheet P1 and a conveying path dedicated for the paper sheet P2. In this manner, the number of components can be reduced and the printer 11 can be miniaturized compared with a case where the conveying path dedicated for the paper sheet P1 and the conveying path dedicated for the paper sheet P2 are provided.

The conveying path 14 includes a holding part 19 (FIG. 14), on the common conveying path R, that can hold both of the overlapping paper sheet P1 and paper sheet P2 respectively pulled out from the first paper roll 21 and the second paper roll 22. When the paper sheet P1 and the paper sheet P2 are held by the holding part 19, the conveying part 14 conveys the paper sheet P1 to the printing part 12 and conveys the paper sheet P2 to the printing part 12 when the paper sheet P1 runs out. Thus, the conveying part 14 does not let the paper sheet P1 and the paper sheet P2 held by the holding part 19 be multi-fed, and conveys the paper sheets one by one. It should be noted that the detailed configuration of the conveying part 14 including the holding part 19 is explained below.

The printing part 12 prints on the paper sheet P1 or the paper sheet P2 conveyed by the conveying part 14. The printing part 12 includes a thermal head and prints characters, figures, and the like on a paper sheet here. It should be noted that the printing part 12 may include, for example, a head that ejects ink to the paper sheet instead of the thermal head.

The cutting part 40 cuts the paper sheet P1 or the paper sheet P2 that is printed on by the printing part 12 to be a predetermined length. The cutting part 40 includes, for example, a fixed blade and a movable blade, and cuts the paper sheet by making the movable blade move while holding the paper sheet with the fixed blade. The paper sheet cut by the cutting part 40 is discharged from a discharging port.

The controlling part 50 controls operation of the printer 11 as a whole. The controlling part 50 controls the operation of the conveying part 14, the printing part 12, the cutting part 40, and the like by executing a program stored in a storing part. For example, the controlling part 50 performs conveyance control of the paper sheet P1 and the paper sheet P2 that are conveyed through the common conveying path R. It should be noted that the details of the conveyance control of the paper sheet P1 and the paper sheet P2 are explained below.

2. A Detailed Configuration of the Conveying Part 14

A detailed configuration of the conveying part 14 is explained with reference to FIGS. 11 to 14. The conveying part 14 includes a paper feeding roller 14*a*, a paper feeding stage 14*b*, a conveying roller 14*d*, an opening-closing part 16, a spring member 17, a stopper 18, a gap adjusting part 30 (FIG. 3), a paper sheet sensor S1, and a paper sheet sensor S3. In the present exemplary embodiment, the paper feeding roller 14*a* is a conveying roller on the upstream side, and the conveying roller 14*d* is a conveying roller on the downstream side. Further, the paper feeding roller 14*a* and the paper feeding stage 14*b* constitute the above-mentioned holding part 19. Hereinafter, the above-mentioned configuration components are explained in order along a feeding direction of the paper sheets P1 and P2.

<A Paper Sheet Sensor S1>

The paper sheet sensor S1 is provided in the vicinity of a paper sheet inserting port 14*c* of the common conveying path R. The paper sheet sensor S1 is a sensor for detecting the number of sheets of paper (any of two, one, and zero sheets). Specifically, the paper sheet sensor S1 detects the number of sheets of paper by using a fact that a voltage, that is an output value, varies in accordance with the number of sheets of paper.

Further, the paper sheet sensor S1 has a function of a detecting sensor for detecting the presence of the paper sheet P1 when the holding part 19 holds the paper sheet P1 and the paper sheet P2. As mentioned above, the paper sheet P1 is conveyed first when the holding part 19 holds the paper sheet P1 and the paper sheet P2, and the paper sheet P2 is conveyed after the paper sheet P1 runs out. For this reason, the paper sheet sensor S1 detects that there is no paper sheet P1 when the number of sheets of paper changes from two to one.

It should be noted that the paper sheet sensor S1 detects two, one, or zero sheets as the number of sheets of paper in the above, but it is not limited to this. For example, the paper sheet sensor S1 may detect one or zero sheets as the number of sheets of paper. Specifically, when the first paper roll is housed in the first housing part 23 and the second paper roll is housed in the second housing part 24, the paper sheet sensor S1 detects that the number of sheets of paper is one. Then, when the paper sheet sensor S1 detects the number of sheets of paper is one and also a detecting sensor S2 provided in the second housing part 24 detects the presence of a paper roll in the second housing part 24, the number of sheets of paper held by the holding part 19 can be determined to be two.

[The Paper Feeding Roller 14*a* and the Paper Feeding Stage 14*b*]

As shown in FIG. 12, the paper feeding roller 14*a* pulls out the paper sheet P1 from the first paper roll 21 and feeds it to the conveying roller 14*d*. Further, the paper feeding roller 14*a* pulls out the paper sheet P2 from the second paper roll 22 and feeds it to the conveying roller 14*d*. The paper feeding roller 14*a* is connected to a motor (a stepping motor herein) of a driving part 15 (FIG. 1) and rotates by receiving a driving force from the motor to feed the paper sheet.

The paper feeding stage 14*b* is provided under the paper feeding roller 14*a* to oppose to the paper feeding roller 14*a*. The paper feeding stage 14*b* includes a function of a guiding member that guides the paper sheet P1 or the paper sheet P2 fed by the paper feeding roller 14*a*. Further, the paper feeding stage 14*b* vertically moves between a holding position for holding the paper sheet and a separated position at which the paper feeding stage 14*b* is separated from the paper feeding roller 14*a* and does not hold the paper sheet.

Figure 15A:
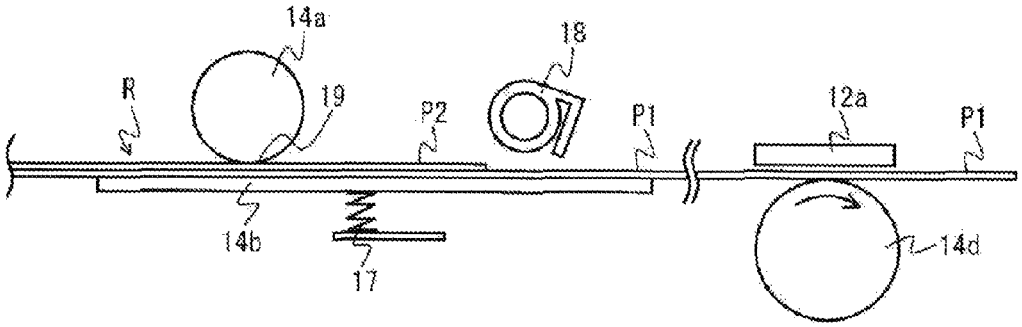
FIG. 15A shows a schematic diagram for explaining positions of a paper feeding stage 14*b* according to a conveyance state of a paper sheet.
Figure 15B:
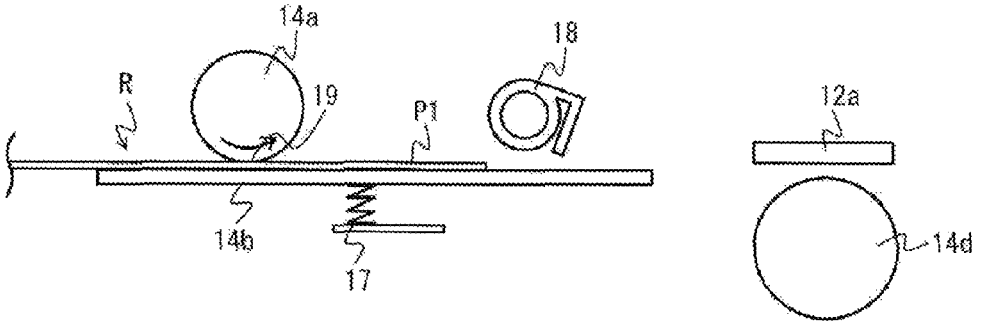
FIG. 15B shows a schematic diagram for explaining positions of a paper feeding stage 14*b* according to a conveyance state of a paper sheet.
Figure 15C:
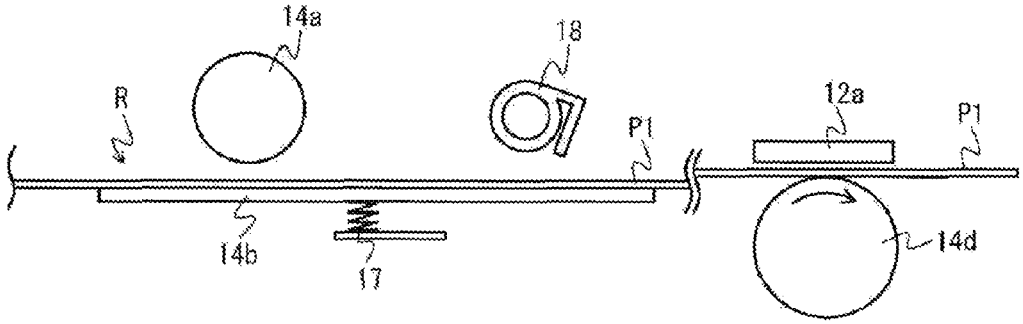
FIG. 15C shows a schematic diagram for explaining positions of a paper feeding stage 14*b* according to a conveyance state of a paper sheet.

FIG. 15 shows a schematic diagram for explaining positions of the paper feeding stage 14*b* according to a conveyance state of the paper sheet. As shown in FIG. 15A, the paper feeding stage 14*b* is at the holding position when two sheets of paper are on the common conveying path R (when the holding part 19 holds the paper sheet P1 and the paper sheet P2) and the conveying roller 14*d* conveys the paper sheet P1. Further, as shown in FIG. 15B, the paper feeding stage 14*b* is at the holding position when only one sheet of paper is on the common conveying path R and the paper feeding roller 14*a* feeds the paper sheet to the conveying roller 14*d*. On the other hand, as shown in FIG. 15C, the paper feeding stage 14*b* is at the separated position when only one sheet of paper is on the common conveying path R and the conveying roller 14*d* conveys the paper sheet.

When the paper sheet P1 and the paper sheet P2 in an overlapped state are held by the paper feeding roller 14*a* and the paper feeding stage 14*b*, which are the holding part 19, the paper feeding stage 14*b* contacts the paper sheet P1 and the paper feeding roller 14*a* contacts with the paper sheet P2 as shown in FIG. 15A. That is, the paper feeding roller 14*a* also functions as a contacting member that contacts the paper sheet P2 out of the paper sheet P1 and paper sheet P2 in the overlapped state.

In the present exemplary embodiment, when the holding part 19 holds the paper sheet P1 and the paper sheet P2, the paper sheet P1 is conveyed by the conveying roller 14*d* on the downstream side. On this occasion, the paper sheet P2 out of the overlapping paper sheet P1 and paper sheet P2 is not conveyed to the downstream side by a frictional resistance of the contacting paper feeding roller 14*a*. On the other hand, because the frictional resistance between the paper sheet P1 and the paper sheet P2 is small, the paper sheet P1 is conveyed to the downstream side by the conveying roller 14*d*.

Further, in the present exemplary embodiment, materials for the paper feeding roller 14*a* and the paper feeding stage 14*b* are selected such that a first frictional resistance between the paper feeding roller 14*a* and the paper sheet P2 is larger than a second frictional resistance between the paper feeding stage 14*b* and the paper sheet P1. For example, the paper feeding roller 14*a* is a roller made of rubber, and the paper feeding stage 14*b* is a plate made of metal. In this manner, the paper sheet P2 can be effectively prevented from being conveyed when the paper sheet P1 is conveyed. It should be noted that the paper feeding roller 14*a* is not limited to the above example and may be a roller made of metal such as SUS as long as the first frictional resistance is larger than the second frictional resistance.

Furthermore, the paper feeding roller 14*a* feeds a front end of the paper sheet P2 held by the holding part 19 to the conveying roller 14*d* when the paper sheet sensor S1 detects no presence of the paper sheet P1 out of the paper sheet P1 and the paper sheet P2. In such a case, the conveying roller 14*d* starts conveying the paper sheet P2 to the printing part 12.

[The Spring Member 17]

The spring member 17 provided to the lower part of the paper feeding stage 14*b* is a biasing member that biases the paper feeding stage 14*b* towards the paper feeding roller 14*a*. The paper feeding stage 14*b* is at the holding position by receiving the bias force of the spring member 17, and holds the paper sheet P1 and the paper sheet P2 between the paper feeding roller 14*a*. It should be noted that the spring member 17 biases the paper feeding stage 14*b* in the above but it is not limited to this. For example, the spring member 17 may bias the paper feeding roller 14*a* towards the paper feeding stage 14*b*.

[The Gap Adjusting Part 30]

The gap adjusting part 30 adjusts a gap between the paper feeding roller 14*a* and the paper feeding stage 14*b* that is biased by the spring member 17. In the present exemplary embodiment, the gap adjusting part 30 adjusts the gap by moving the paper feeding stage 14*b* vertically between the holding position and the separated position. The gap adjusting part 30 resists the bias force of the spring member 17 and moves the paper feeding stage 14*b* downwards from the holding position to the separated position. The gap between the paper feeding roller 14*a* and the paper feeding stage 14*b* when the paper feeding stage 14*b* is at the separated position (see FIG. 15C) is larger than the gap when the paper feeding stage 14*b* is at the holding position (see FIG. 15A). In this manner, the paper feeding roller 14*a* and the conveying roller 14*d* can smoothly convey the paper sheet P1 and the paper sheet P2. The gap adjusting part 30 includes a gear 31 as shown in FIG. 3, and the gear 31 rotates by receiving a power of a driving source such that the paper feeding stage 14*b* moves vertically.

[The Opening-Closing Part 16]

As shown in FIG. 13 and FIG. 14, the opening-closing part 16 rotates around an axis 16*a* between an opening position and a closing position. The opening-closing part 16 supports the paper feeding roller 14*a* and the paper feeding roller 14*a* included in the holding part 19 also is opened and closed by interlocking with the opening-closing part 16. A user can set the paper sheet P1 and the paper sheet P2 on the paper feeding stage 14*b* when the opening-closing part 16 is at the opening position (the paper feeding roller 14*a* is at the opening position) (FIG. 13).

A handle 16*b* for a user to rotate the opening-closing part 16 is provided to the opening-closing part 16. For example, the opening-closing part 16 rotates from the closing position to the opening position as the user raises the handle 16*b*. It should be noted that there may be a first opening position and a second opening position as the opening position. The first opening position is a position where the opening-closing part 16 is fully opened, and the second opening position is a position where the opening angle of the opening-closing part 16 is smaller than that of the first opening position. The user can set the paper sheet on the paper feeding stage 14*b* not only when the opening-closing part 16 is at the first opening position but also at the second opening position. In such a case, because the user rotates the opening-closing part 16 to the second opening position to set the paper sheet, and also because the opening-closing part 16 can be stopped from being further rotated from the first opening position by the user, the opening-closing part 16 can be prevented from being damaged by receiving an excessive load.

[A Stopper 18]

The stopper 18 is positioned above the paper feeding stage 14*b* on the downstream side in the conveying direction of the holding part 19. Further, the stopper 18 is supported by the axis 16*a* of the opening-closing part 16 and rotates by interlinking with the rotation of the opening-closing part 16. The stopper 18 includes an eccentric part 18*a* that is at an eccentric position with respect to the axis in a radial direction. When the opening-closing part 16 is at the closing position, the eccentric part 18*a* is positioned at a separated position where the eccentric part 18*a* is away from the paper feeding stage 14*b* (see FIG. 11), and when the opening-closing part 16 is at the opening position, the eccentric part 18*a* is positioned at a contacting position where the eccentric part 18*a* contacts the paper feeding stage 14*b* (see FIG. 13).

Additionally, when the eccentric part 18*a* is at the contacting position, the front end of the paper sheet P1 or the paper sheet P2 set on the paper feeding stage 14*b* cannot be positioned on the downstream side from the stopper 18 in the conveyance direction as shown in FIG. 13. That is, the stopper 18 is a regulating member that regulates the front end of the paper sheet P1 or the paper sheet P2 to be arranged on the upstream side from the conveying roller 14*d* when the paper sheet P1 or the paper sheet P2 is set on the paper feeding stage 14*b* when the paper feeding roller 14*a* is open.

[A Paper Sheet Sensor S3]

The paper sheet sensor S3 is a sensor for detecting the paper sheet P1 or the paper sheet P2 that is fed by the paper feeding roller 14*a* to the conveying roller 14*d*. The paper sheet sensor S3 is provided in the vicinity of the upstream side of the conveying roller 14*d* in the conveying direction.

[The Conveying Roller 14*d*]

The conveying roller 14*d* is provided on the downstream side of the paper sheet sensor S3 in the conveying direction and conveys the paper sheet P1 and the paper sheet P2. The conveying roller 14*d* conveys the paper sheet P1 and the paper sheet P2 fed by the paper feeding roller 14*a* to the downstream side. Here, because a paper sheet conveyance speed by the paper feeding roller 14*a* is smaller than the paper sheet conveyance speed by the conveying roller 14*d*, the paper feeding roller 14*a* does not rotate when the conveying roller 14*d* conveys the paper sheet P1.

The conveying roller 14*d* is arranged at a position opposing a head of the printing part 12 and functions as a platen. Further, when the holding part 19 (the paper feeding roller 14*a* and the paper feeding stage 14*b*) holds the paper sheet P1 and the paper sheet P2, the conveying roller 14*d* conveys the paper sheet P1 out of the paper sheet P1 and the paper sheet P2.

It should be noted that the paper sheet conveyance speed by the paper feeding roller 14*a* and the paper sheet conveyance speed by the conveying roller 14*d* are different in the above, but it is not limited to this. For example, while the paper sheet conveyance speeds by the paper feeding roller 14*a* and the conveying roller 14*d* are the same, the paper sheet conveyance force of the conveying roller 14*d* may be larger than the paper sheet conveying force of the paper feeding roller 14*a*. In such a case, when the conveying roller 14*d* conveys the paper sheet P1, the paper sheet is smoothly transferred as the paper feeding roller 14*a* is not being rotated.

The conveying roller 14*d* is at the position opposing the head of the printing part 12 (a head 12*a* shown in FIG. 15) in the above, but it is not limited to this. For example, the conveying roller 14*d* may be arranged on the upstream side from the printing part 12 in the conveying direction.

3. A Conveyance Control of the Paper Sheet

As explained above, the conveying part 14 conveys the paper sheet in a condition where two sheets of papers are set to the holding part 19 (the paper feeding roller 14*a* and the paper feeding stage 14*b*), that is, the paper sheet P1 and the paper sheet P2 are held. In the present exemplary embodiment, the controlling part 50 performs below-mentioned control to smoothly convey the two sheets of papers.

When a first sheet of paper (herein, the paper sheet P1) is set to the holding part 19, the controlling part 50 makes the paper feeding roller 14*a* send the paper sheet P1 to the conveying roller 14*d*, and when the paper sheet P2 is set on the paper sheet P1, the controlling part 50 makes the paper feeding roller 14*a* not send the paper sheet P2 to the conveying roller 14*d*. Then, the controlling part 50 makes the conveying roller 14*d* convey the paper sheet P1 out of the paper sheet P1 and the paper sheet P2 that are held by the holding part 19 to the printing part 12 while the paper feeding roller 14*a* is in a state where the rotation is stopped (specifically, stationary excitation is caused in a driving motor of the paper feeding roller 14*a*). On this occasion, the paper sheet P2 receives a frictional resistance of the contacted paper feeding roller 14*a* and is not conveyed. Accordingly, even when the holding part 19 holds the paper sheets P1 and P2, the paper sheets P1 and P2 are not being multi-fed and the paper sheet P1 is properly conveyed to the printing part 12.

Figure 16:
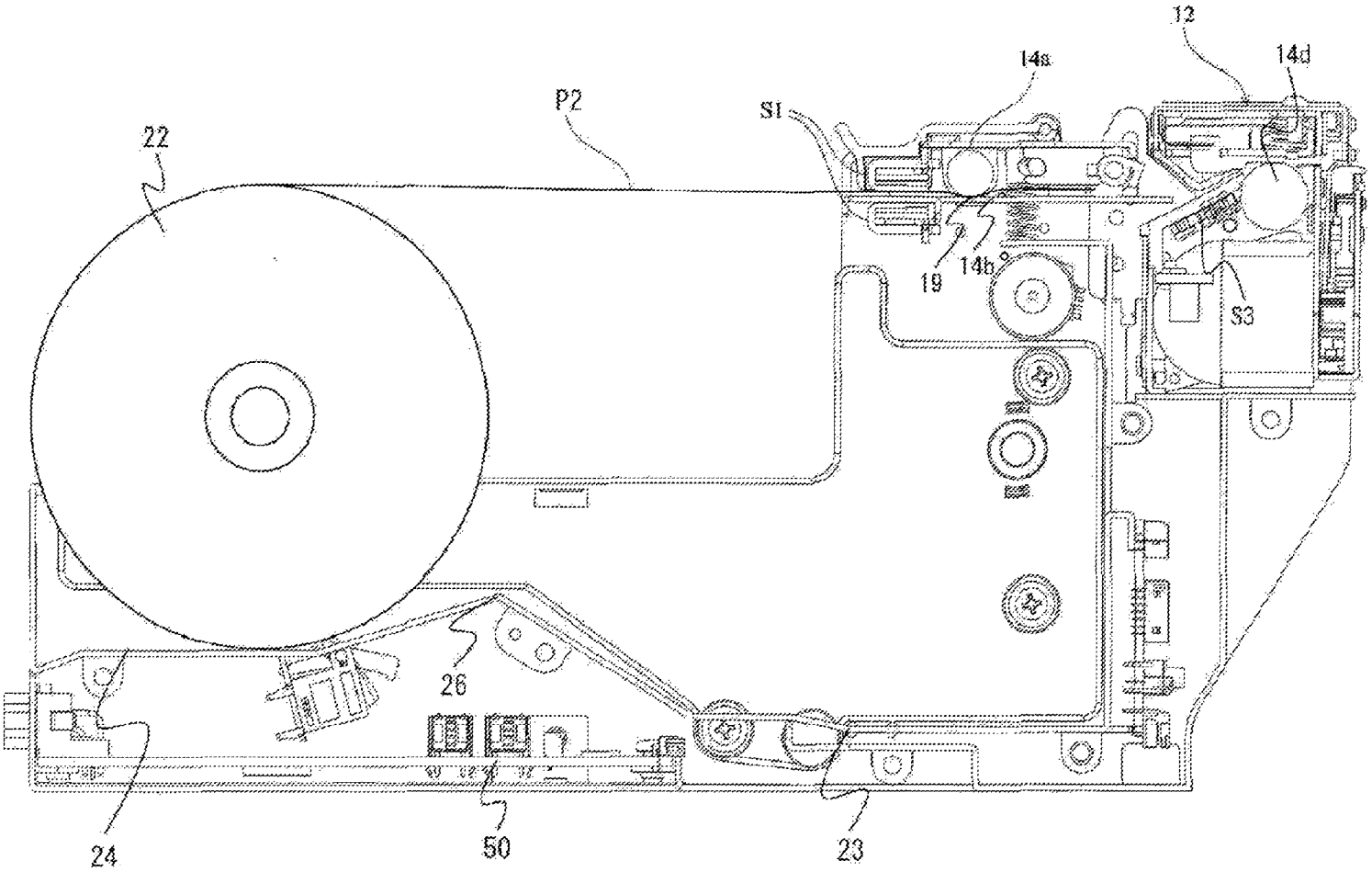
FIG. 16 shows a state where there is no first paper roll 21.

FIG. 16 shows a state where there is no first paper roll 21. If printing on the paper sheet P1 continues while the holding part 19 is holding the paper sheets P1 and P2, the first paper roll 21 runs out as shown in FIG. 16. Then, when the paper sheet sensor S1 detects that there is no paper sheet P1 to be conveyed to the printing part 12, the controlling part 50 makes the conveying part 14 convey the paper sheet P2 held by the holding part 19 to the printing part 12.

Figure 17:
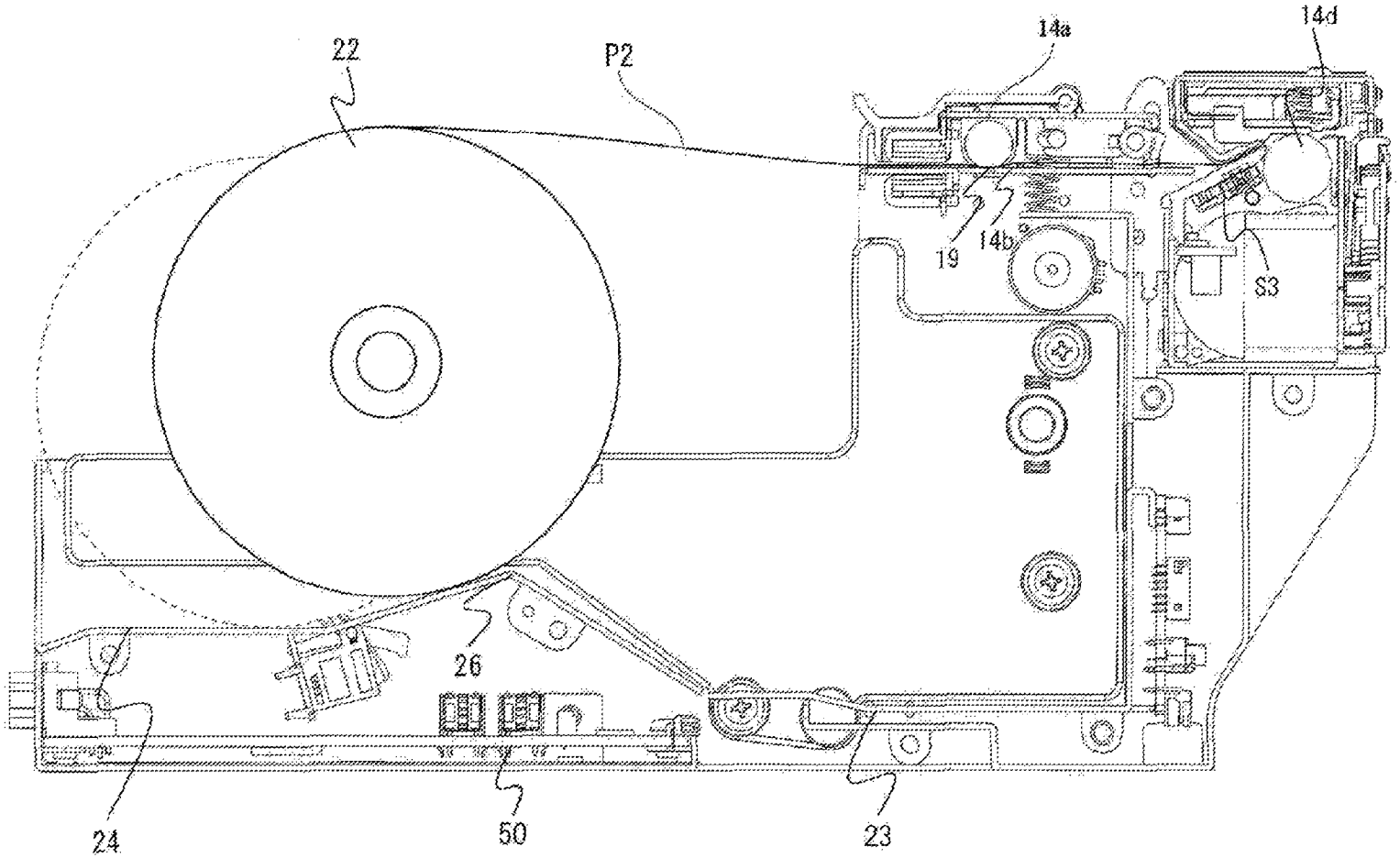
FIG. 17 shows a state where the paper feeding roller 14*a* feeds the paper sheet P2.
Figure 18:
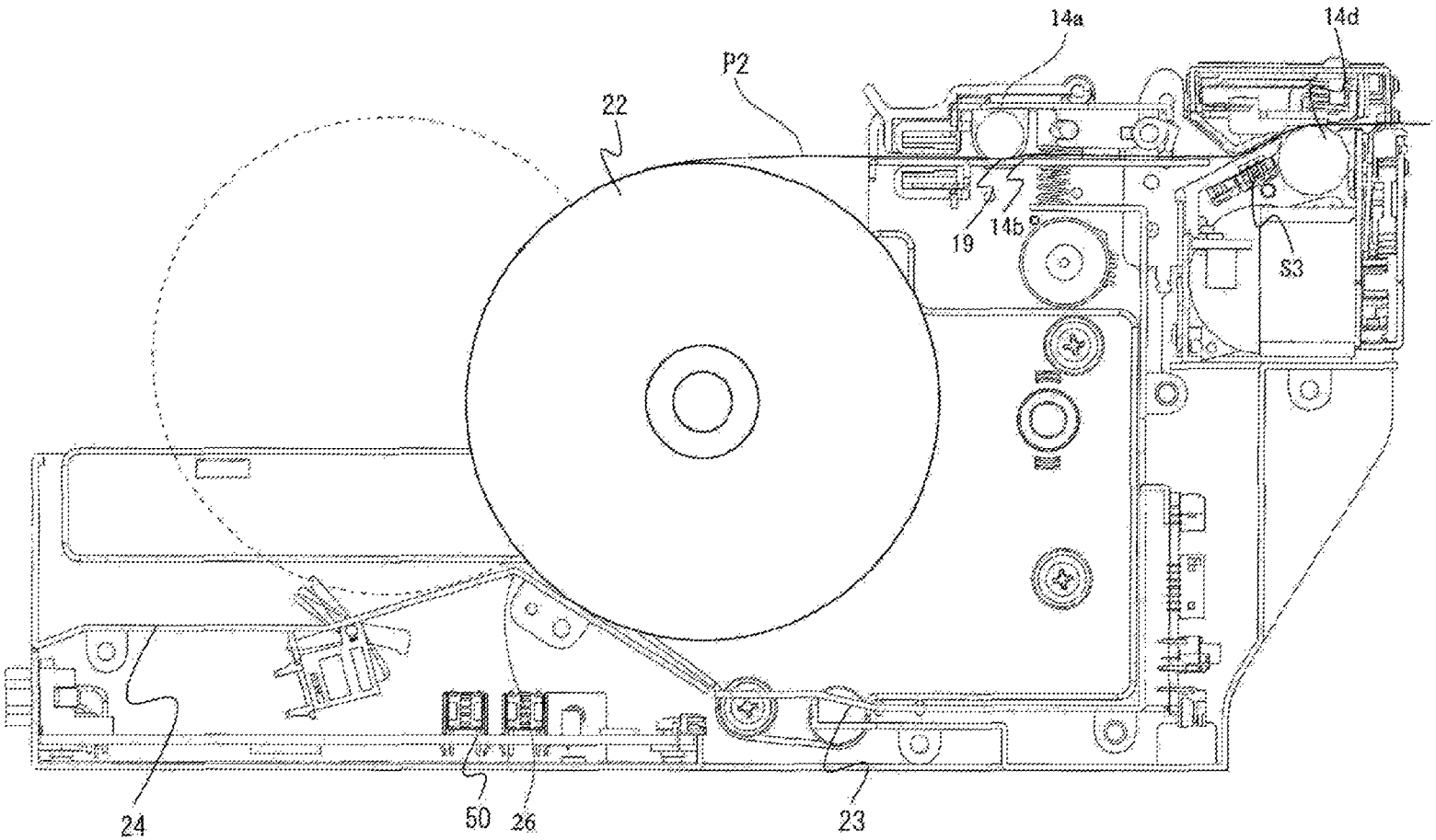
FIG. 18 shows a state where a conveying roller 14*d* conveys the paper sheet P2.

FIG. 17 shows a state where the paper feeding roller 14*a* feeds the paper sheet P2. FIG. 18 shows a state where the conveying roller 14*d* conveys the paper sheet P2. When the first paper roll 21 runs out, the controlling part 50 makes the paper feeding roller 14*a* feed the front end of the paper sheet P2 to the conveying roller 14*d* as shown in FIG. 17. Then, after a predetermined time (an estimated time for the front end of the paper sheet P2 to reach the conveying roller 14*d*) passes from the time when the paper sheet sensor S3 detects the fed paper sheet P2, the controlling part 50 stops the rotation of the paper feeding roller 14*a* and makes the conveying roller 14*d* convey the paper sheet P2 as shown in FIG. 18. In this manner, the paper sheet P2 can be properly conveyed to the printing part 12 after the paper sheet P1 runs out.

Figure 19:
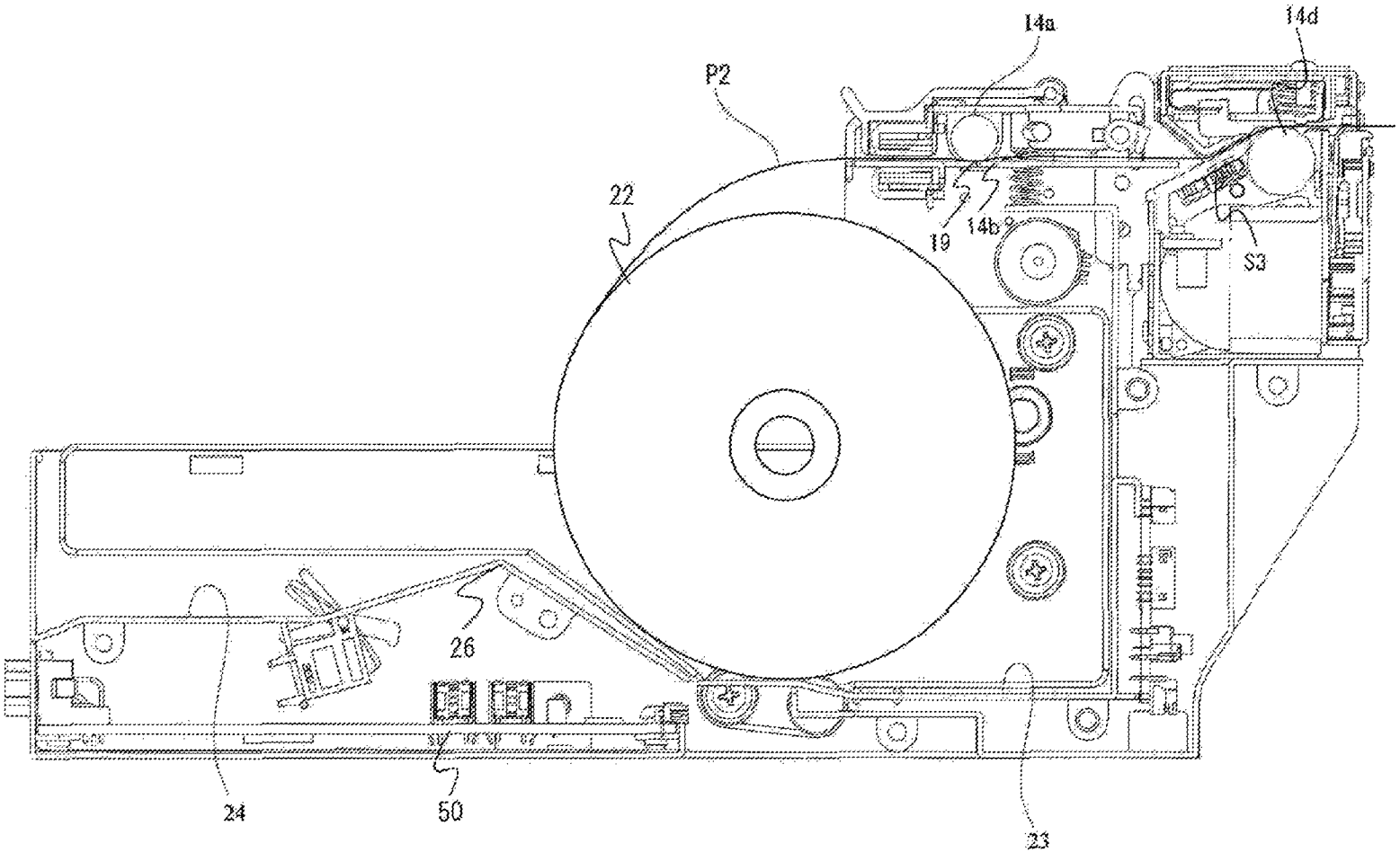
FIG. 19 shows a state where the paper roll 22 is housed in a first housing part 23.

FIG. 19 shows a state where the paper roll 22 is housed in the first housing part 23. When the paper sheet sensor S1 detects that there is no paper sheet P1 to be conveyed to the printing part 12, the controlling part 50 moves the second paper roll 22 housed in the second housing part 24 to the first housing part 23 at the time when the paper sheet P2 held by the holding part 19 is conveyed to the printing part 12. Accordingly, the second paper roll 22 comes to be housed in the first housing part 23 as shown in FIG. 19.

As mentioned above, a convex part 26 is provided between the first housing part 23 and the second housing part 24. Therefore, the controlling part 50 makes the paper sheet P2 held by the holding part 19 conveyed to the printing part 12 such that the second paper roll 22 housed in the second housing part 24 runs over the convex part 26 and moves to the first housing part 23. Specifically, when the paper feeding roller 14*a* feeds the paper sheet P2 towards printing part 12, the second paper roll 22 runs over the convex part 26 by being pulled by the fed paper sheet P2 as shown in FIG. 17 and FIG. 18. Then, the paper roll 22 is moved and housed in the first housing part 23 as shown in FIG. 19. Accordingly, the second paper roll 22 in the second housing part 24 is automatically moved to the first housing part 23 after the first paper roll 21 in the first housing part 23 runs out. Consequently, the user can easily set an additional paper roll to the second housing part 24.

Further, when the paper sheet sensor S1 detects that there is no paper sheet P1 while the printing part 12 is printing the printing data on the paper sheet P1, the controlling part 50 makes the paper sheet P2 held by the holding part 19 be conveyed to the printing part 12 and makes the printing part 12 print the printing data again on the paper sheet P2. Accordingly, even when a paper sheet runs out during printing, the printing data is ensured to be printed on a subsequent sheet of paper.

4. Operation of the Printer

An example of operation of the printer 11 when the first paper roll 21 and the second paper roll 22 are set and the paper sheets P1 and P2 are conveyed is described with reference to FIGS. 20 to 22. The operations explained below are realized by executing a program that the controlling part 50 stores in the storing part.

[4-1. At the Time when a First Paper Roll is Set]

Figure 20:
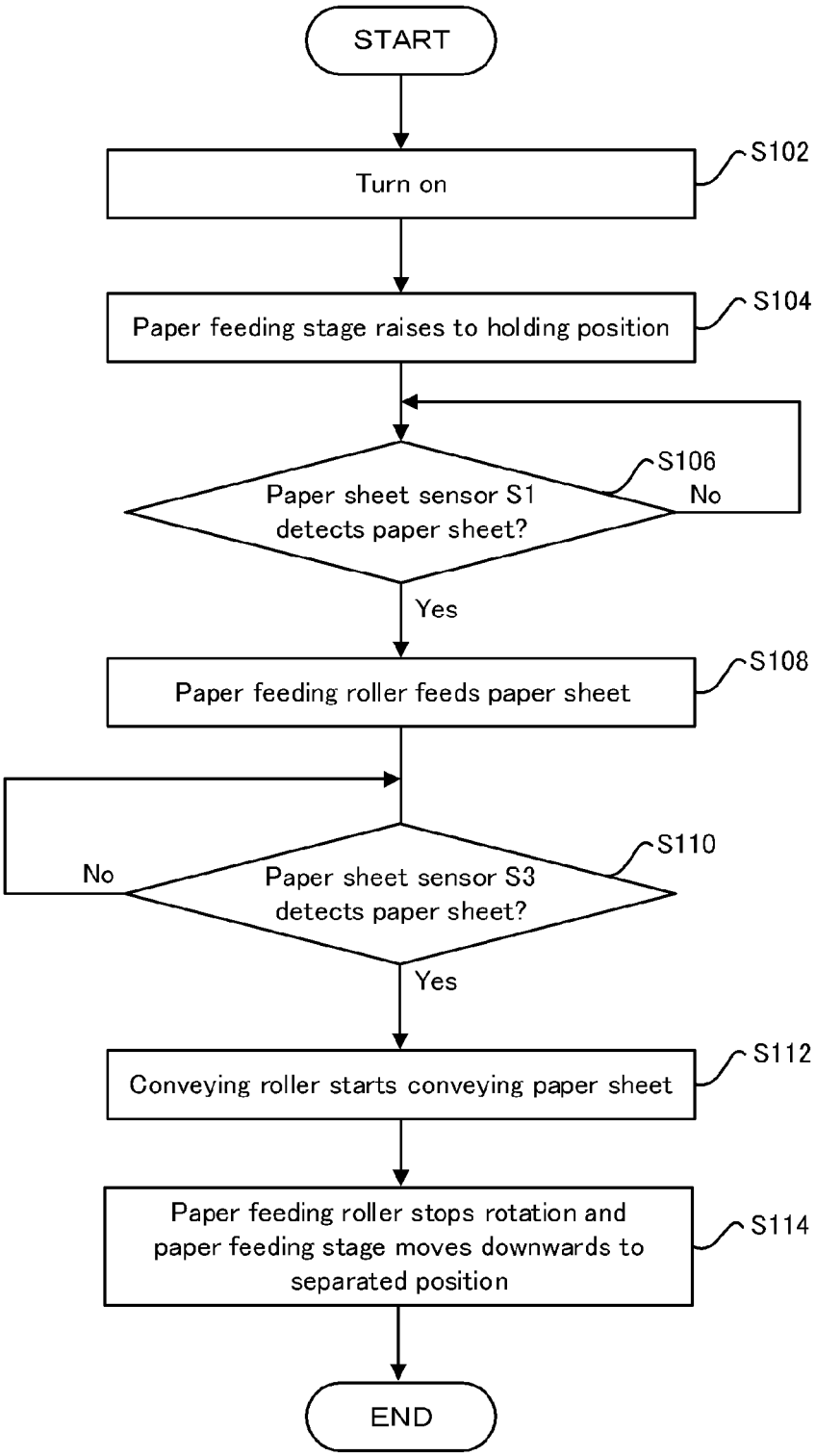
FIG. 20 shows a flow chart of operation of the printer 11 when the first paper roll 21 is set to the first housing part 23.

FIG. 20 shows a flow chart of operations of the printer 11 when the first paper roll 21 is set in the first housing part 23. The flow chart of FIG. 20 starts at the time when the printer 11 is turned on (step S102). Next, the controlling part 50 detects that there is no paper sheet in the holding part 19 with the paper sheet sensor S1, and raises the paper feeding stage 14*b* from the separated position to the holding position (step S104). Then, an operator sets a first roll of the first paper roll 21 to the first housing part 23 and sets the paper sheet P1, which is pulled out from the first paper roll 21 by opening the opening-closing part 16, to the holding part 19.

When the paper sheet sensor S1 detects the paper sheet P1 set in the holding part 19 (step S106: Yes), the controlling part 50 rotates the paper feeding roller 14*a* to feed the paper sheet P1 to the conveying roller 14*d* (step S108). The fed paper sheet P1 reaches the conveying roller 14*d* by passing through the paper sheet sensor S3 in the common conveying path R.

Next, when the paper sheet sensor S3 detects the paper sheet P1 (step S110: Yes), the controlling part 50 makes the conveying roller 14*d* start to convey the paper sheet P1 (step S112). Then, the controlling part 50 stops the rotation of the paper feeding roller 14*a* and moves the paper feeding stage 14*b* downwards from the holding position to the separated position (step S114). In this manner, the paper sheet P1 is then conveyed by the conveying roller 14*d* and is printed by the printing part 12.

[4-2. At the Time when a Second Paper Roll is Set]

Figure 21:
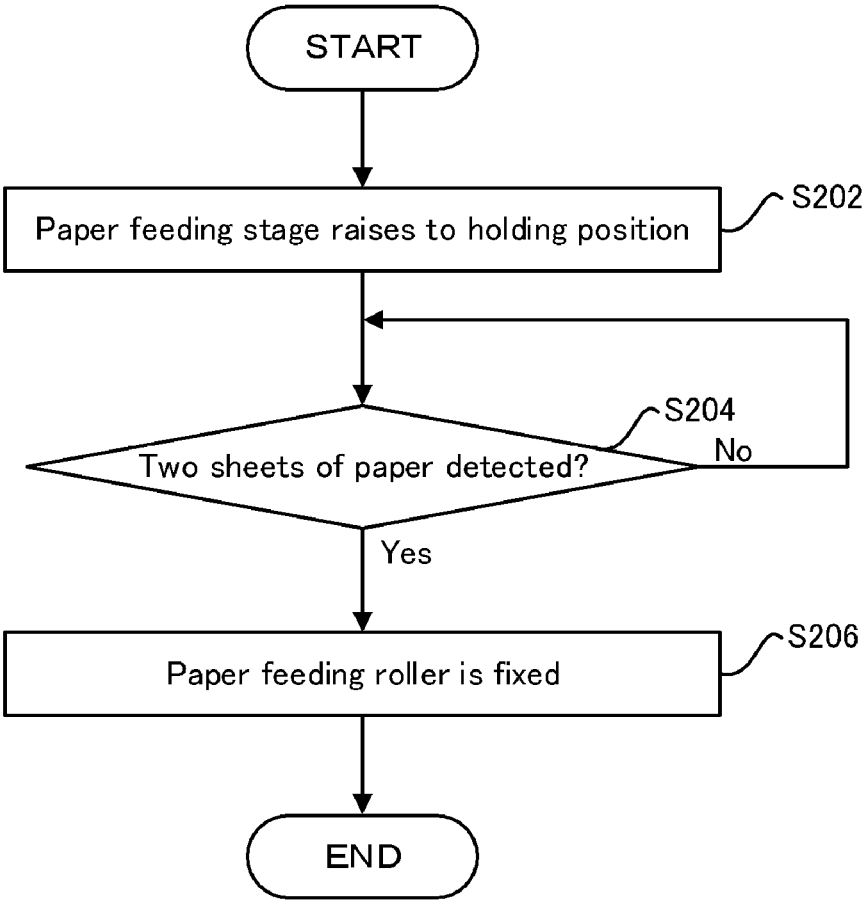
FIG. 21 shows a flow chart of operation of the printer 11 when the second paper roll 22 is set to a second housing part 24.

FIG. 21 shows a flow chart of operation of the printer 11 when the second paper roll 22 is set to the second housing part 24. The flow chart of FIG. 21 starts when an operator opens the opening-closing part 16 to set a second roll of the second paper roll 22. First, the controlling part 50 detects that the opening-closing part 16 is opened, and raises the paper feeding stage 14*b* from the separated position to the holding position (step S202). Then, the operator sets the second roll of the second paper roll 22 to the second housing part 24 and sets the paper sheet P2, which is pulled out from the second paper roll 22, on the paper sheet P1.

Next, when the paper sheet sensor S1 detects two sheets of paper (step S204: Yes), the controlling part 50 causes stationary excitation in a motor connected to the paper feeding roller 14*a* and fixes the paper feeding roller 14*a* (step S206). In this manner, when the conveying roller 14*d* rotates to convey the paper sheet P1, the paper sheet P2 receives a frictional resistance of the paper feeding roller 14*a* and is not conveyed.

[4-3. At the Time when a First Paper Roll Runs Out]

Figure 22:
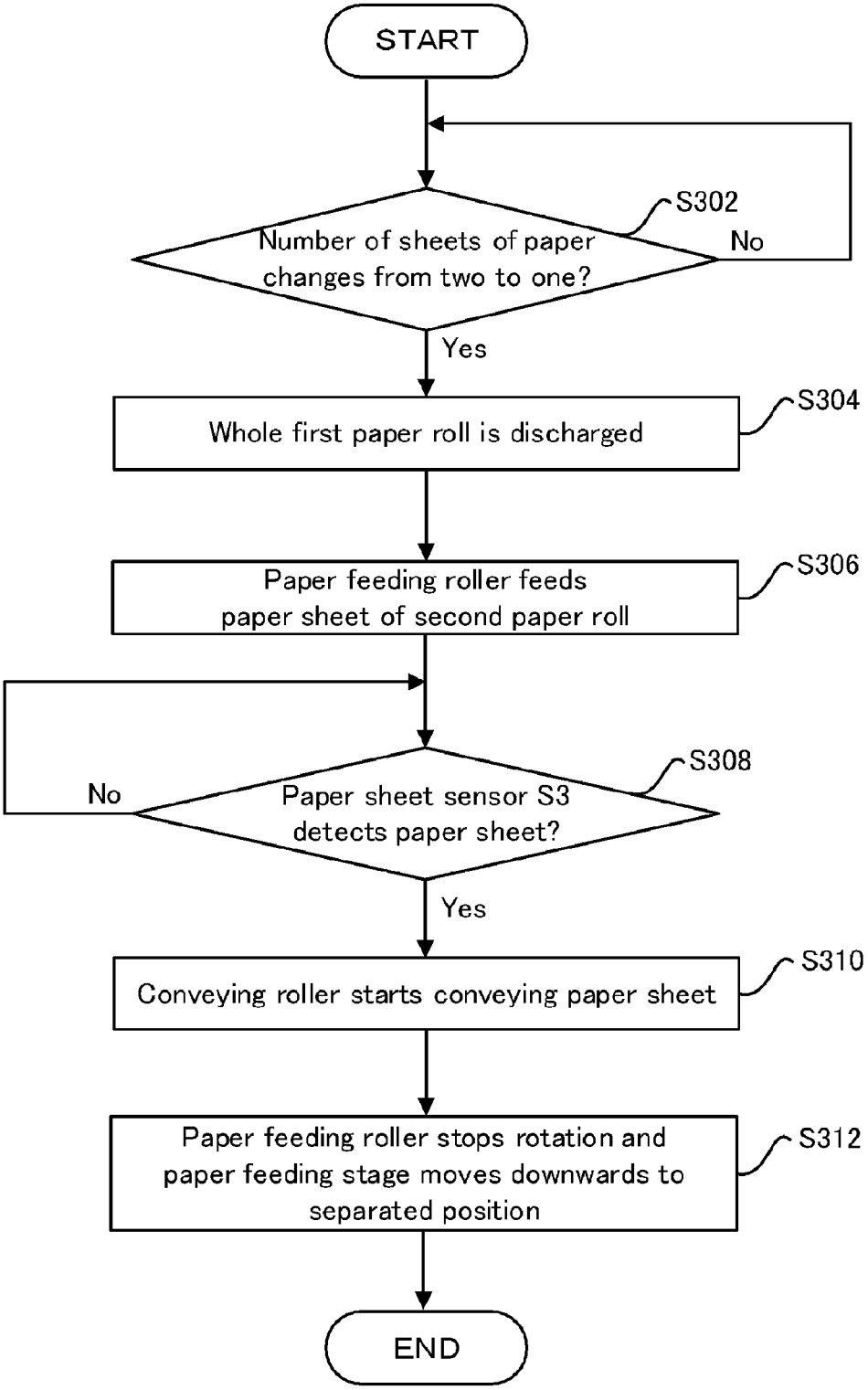
FIG. 22 shows a flow chart of operation of the printer 11 when a first roll of the first paper roll 21 runs out.

FIG. 22 shows a flow chart of operation of the printer 11 when a first roll of the first paper roll 21 runs out. First, the controlling part 50 detects whether or not the number of sheets of paper held by the housing part 19 changes from two to one with the paper sheet sensor S1 (step S302). When the first paper roll 21 runs out and the paper sheet sensor S1 detects that the number of sheets of paper is one (step S302: Yes), the controlling part 50 discharges the paper sheet P1 remaining on the common conveying path R (step S304).

Next, the controlling part 50 rotates the paper feeding roller 14*a* and feeds the paper sheet P2 held by the holding part 19 to the conveying roller 14*d* (step S306). The fed paper sheet P2 passes the paper sheet sensor S3 in the common conveying path R and reaches the conveying roller 14*d*. On this occasion, the second paper roll 22 housed in the second housing part 24 is pulled by the paper sheet P2 to be fed and is moved to the first housing part 23.

Next, when the paper sheet sensor S3 detects the paper sheet P2 (step S308: Yes), the controlling part 50 makes the conveying roller 14*d* start to convey the paper sheet P2 (step S310). Then, the controlling part 50 stops the rotation of the paper feeding roller 14*a* and moves the paper feeding stage 14*b* downwards from the holding position to the separated position (step S312). In this manner, the paper sheet P2 is then conveyed to the conveying roller 14*d* and is printed by the printing part 12.

5. An Effect According to the Present Exemplary Embodiment

In the printer 11 according to the present exemplary embodiment, the paper sheet P1 out of the paper sheet P1 and the paper sheet P2 held by the holding part 19 in the common conveying path R is conveyed to the printing part 12 and is printed. Then, when the paper sheet sensor S1 detects that there is no paper sheet P1 to be conveyed to the printing part 12, the conveying part 14 conveys the paper sheet P2 held by the holding part 19 to the printing part 12. In such a case, even when the first paper roll 21 and the second paper roll 22 are set to the printer 11, the holding part 19 in the common conveying path of the paper sheet P1 and the paper sheet P2 can convey each paper sheet one by one to the printing part 12 without multi-feeding the paper sheet P1 and the paper sheet P2. Consequently, each paper sheet of a plurality of paper rolls can be conveyed to the printing part 12 with a simple configuration with no conveying paths dedicated respectively for the paper sheets P1 and P2.

The present invention is applied to the printer 11 that is a printing apparatus in the above, but it is not limited to this. For example, the present invention is applicable to a paper supply apparatus with no printing part (for example, a paper supply cassette).

Further, the holding part 19 consists of the paper feeding roller 14*a* and the paper feeding stage 14*b* in the above, but it is not limited to this. For example, the holding part 19 may consist of the paper feeding roller 14*a* and a roller opposing the paper feeding roller 14*a*. Further, the holding part 19 may include a roller with no conveying function instead of the paper feeding roller 14*a*.

The present invention is described with the exemplary embodiments of the present invention but the technical scope of the present invention is not limited to the scope described in the above embodiment. It is apparent for those skilled in the art that it is possible to make various changes and modifications to the embodiment. It is apparent from the description of the scope of the claims that the forms added with such changes and modifications are included in the technical scope of the present invention.

What is claimed is:

1. A printing apparatus, comprising:

a first housing part that houses a first paper roll that is a roll of a first paper sheet;

a second housing part that houses a second paper roll that is a roll of a second paper sheet;

a printing part that prints on the first paper sheet and the second paper sheet;

a conveying part including a holding part that is configured to hold the first paper sheet and the second paper sheet in an overlapped state and the first paper sheet and the second paper are respectively pulled out from the first paper roll and the second paper roll, the conveying part conveying the first paper sheet out of the first paper sheet and the second paper sheet held by the holding part to the printing part;

a detecting sensor that detects the presence of the first paper sheet; and a controlling part that makes the conveying part convey the second paper sheet held by the holding part to the printing part when the detecting sensor detects that there is no first paper sheet to be conveyed to the printing part, wherein the holding part includes:

a contacting member that contacts the second paper sheet out of the first paper sheet and the second paper sheet in an overlapped state; and an opposing member that is arranged opposing the contacting member and contacts the first paper sheet, and a first frictional force between the contacting member and the second paper sheet is larger than a second frictional force between the opposing member and the first paper sheet.

2. The printing apparatus according to claim 1, wherein the conveying part further includes:

a downstream side conveying roller that is provided on the downstream side of the holding part in the conveying direction, and conveys the first paper sheet out of the first paper sheet and the second paper sheet held by the holding part to the printing part, wherein the contacting member is an upstream side conveying roller that is provided on the upstream side of the downstream side conveying roller in the conveying direction, and sends a front end of the second paper sheet held by the holding part to the downstream side conveying roller when the detecting sensor detects that there is no first paper sheet.

3. The printing apparatus according to claim 2, wherein the controlling part makes the downstream side conveying roller connected to a driving source convey the first paper sheet out of the first paper sheet and the second paper sheet held by the holding part to the printing part with the upstream side conveying roller in a state where the rotation is stopped.

4. The printing apparatus according to claim 2, wherein the opposing member is a guiding member that guides the first paper sheet and the second paper sheet to be conveyed, and the holding part further includes a biasing member that biases the opposing member towards the contacting member.

5. The printing apparatus according to claim 2, wherein a paper sheet conveyance speed by the upstream side conveying roller is smaller than the paper sheet conveyance speed by the downstream side conveying roller, and the controlling part makes the upstream side conveying roller send the front end of the second paper sheet to the downstream side conveying roller, stops the rotation of the upstream side conveying roller, and makes the downstream side conveying roller convey the second paper sheet.

6. The printing apparatus according to claim 5, further including a gap adjusting part that adjusts a gap between the contacting member and the opposing member, wherein the gap adjusting part makes the gap when the downstream side conveying roller conveys the second paper sheet larger than the gap when the upstream side conveying roller conveys the second paper sheet to the downstream side conveying roller.

7. The printing apparatus according to claim 2, wherein the holding part is configured to become opened and closed, and the printing apparatus further comprises:

a regulating member that regulates the front ends of the first paper sheet and the second paper sheet to be positioned on the upstream side from the downstream side conveying roller when the first paper sheet pulled out from the first paper roll or the second paper sheet pulled out from the second paper roll is set to the conveying part in a state where the holding part is opened.

8. The printing apparatus according to claim 7, wherein the controlling part makes the upstream side conveying roller send the first paper sheet to the downstream side conveying roller when the first paper sheet is set, and makes the upstream side conveying roller not send the second paper sheet to the downstream side conveying roller when the second paper sheet is set on the first paper sheet.

9. The printing apparatus according to claim 1, wherein the first housing part is positioned at a downstream side of the second housing part in a pull-out direction of the first paper sheet, and a controlling part moves the second paper roll housed in the second housing part to the first housing part when the second paper sheet held by the holding part is conveyed to the printing part in a case when the detecting sensor detects that there is no first paper sheet to be conveyed to the printing part.

10. The printing apparatus according to claim 9, further comprising:

a convex part that is provided between the first housing part and the second housing part; wherein the controlling part conveys the second paper sheet held by the holding part to the printing part such that the second paper roll housed in the second housing part runs over the convex part and moves to the first housing part.

11. The printing apparatus according to claim 1, wherein the controlling part makes the second paper sheet held by the holding part be conveyed to the printing part and prints printing data again on the second paper sheet when the detecting sensor detects that there is no first paper sheet while the printing part is printing the printing data on the first paper sheet.

12. A paper supply apparatus, comprising:

a first housing part that houses a first paper roll that is a roll of a first paper sheet;

a second housing part that houses a second paper roll that is a roll of a second paper sheet;

a conveying part including a holding part that is configured to hold the first paper sheet and the second paper sheet in an overlapped state and the first paper sheet and the second paper are respectively pulled out from the first paper roll and the second paper roll, the conveying part conveying the first paper sheet out of the first paper sheet and the second paper sheet held by the holding part to a printing part;

a detecting sensor that detects the presence of the first paper sheet; and a controlling part that makes the conveying part convey the second paper sheet held by the holding part to the printing part when the detecting sensor detects that there is no first paper sheet to be conveyed to the printing part, wherein the holding part includes:

a contacting member that contacts the second paper sheet out of the first paper sheet and the second paper sheet in an overlapped state; and an opposing member that is arranged opposing the contacting member and contacts the first paper sheet, and a first frictional force between the contacting member and the second paper sheet is larger than a second frictional force between the opposing member and the first paper sheet.

13. A paper supply method, comprising:

conveying a first paper sheet out of an overlapping first paper sheet and second paper sheet held by a holding part to a printing part by a conveying part that conveys the first paper sheet and the second paper sheet respectively pulled out from a first paper roll and a second paper roll;

detecting the presence of the first paper sheet by a detecting sensor; and conveying the second paper sheet held by the holding part to the printing part by operating the conveying part when the detecting sensor detects that there is no first paper sheet to be conveyed to the printing part, wherein the holding part includes:

a contacting member that contacts the second paper sheet out of the first paper sheet and the second paper sheet in an overlapped state; and an opposing member that is arranged opposing the contacting member and contacts the first paper sheet, and a first frictional force between the contacting member and the second paper sheet is larger than a second frictional force between the opposing member and the first paper sheet.

* * * * *